US006828070B2

(12) United States Patent
Ishikawa et al.

(10) Patent No.: US 6,828,070 B2
(45) Date of Patent: Dec. 7, 2004

(54) PHOTOSENSITIVE MATERIAL COMPRISING REVERSIBLY DECOLORABLE COLORED LAYER AND IMAGE-FORMING METHOD USING SAME

(75) Inventors: Shunichi Ishikawa, Kanagawa-ken (JP); Yoshiharu Yabuki, Saitama-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 72 days.

(21) Appl. No.: 09/886,121

(22) Filed: Jun. 22, 2001

(65) Prior Publication Data

US 2002/0015903 A1 Feb. 7, 2002

(30) Foreign Application Priority Data

Jun. 23, 2000 (JP) ..... 2000-190326

(51) Int. Cl.[7] ..... G03C 1/498; G03C 1/005; G03C 1/825; G03C 8/40

(52) U.S. Cl. ..... 430/21; 430/350; 430/510; 430/517; 430/619

(58) Field of Search ..... 430/19, 21, 350, 430/351, 353, 510, 517, 619; 503/204, 207, 227

(56) References Cited

U.S. PATENT DOCUMENTS

| | | | | |
|---|---|---|---|---|
| 3,761,942 A | * | 9/1973 | Lorenz et al. | 346/1 |
| 4,028,118 A | | 6/1977 | Nakasuji et al. | |
| 5,702,850 A | * | 12/1997 | Nishioka et al. | 430/19 |
| 5,725,990 A | * | 3/1998 | Hirai et al. | 430/203 |
| 6,051,359 A | | 4/2000 | Ohkawa et al. | 430/203 |

FOREIGN PATENT DOCUMENTS

| | | | |
|---|---|---|---|
| JP | 4-013128 A | * | 1/1992 |
| JP | 2001-51371 | | 2/2001 |

* cited by examiner

*Primary Examiner*—John A. McPherson
(74) *Attorney, Agent, or Firm*—Sughrue Mion, PLLC

(57) ABSTRACT

A photosensitive material comprising a substrate and a reversibly decolorable colored layer disposed thereon, wherein the reversibly decolorable colored layer is reversibly colored and decolored, the reversibly decolorable colored layer is in a colored state at 25 ° C., and a temperature at which the color density of the reversibly decolorable colored layer is reduced to 50% based on that at 25 ° C. is 50 to 120 ° C. A method for forming an image using the photosensitive material is also provided.

6 Claims, No Drawings

PHOTOSENSITIVE MATERIAL COMPRISING REVERSIBLY DECOLORABLE COLORED LAYER AND IMAGE-FORMING METHOD USING SAME

BACKGROUND OF THE INVENTION

The present invention relates to a photosensitive material having a colored layer, which exhibits an excellent stability even under hard storage conditions, and can be easily decolored if necessary. The present invention also relates to a method for forming an image using the photosensitive material.

In photosensitive materials, a photosensitive silver halide emulsion layer, etc. is often colored so that the photosensitive material absorbs a light of a particular wavelength.

For example, to control a light to be irradiated to the silver halide emulsion layer with respect to a spectral composition, a colored layer is disposed farther from a substrate than the silver halide emulsion layer. Such a colored layer is called a filter layer. In the case of a photosensitive material comprising a plurality of silver halide emulsion layers such as a multi-layered color photosensitive material for photographing, the filter layer may be disposed between the silver halide emulsion layers.

A scattered light, which is generated while or after an incident light passes through the silver halide emulsion layer, is often reflected at the interface between the silver halide emulsion layer and the substrate, or at the back surface of the substrate. When the reflected light is introduced into the silver halide emulsion layer, image ambiguity, so-called halation, is often caused. To prevent the halation, the colored layer may be disposed between the silver halide emulsion layer and the substrate or on the back surface of the substrate. Such a colored layer is called an antihalation layer. In the case of a photosensitive material comprising a plurality of silver halide emulsion layers, the antihalation layer may be disposed between the silver halide emulsion layers.

The colored layers are needed only in an exposing process, and thereafter become useless. Particularly, in the case where an image information provided on the photosensitive material is read by a scanner and where the colored layer has an absorption wavelength overlapping with the scanning wavelength, the image information is inevitably made high in density, resulting in a noisy image. Thus, it is preferable that the color density of the colored layer is reduced at least to some extent after the exposing process.

The colored layer in conventional wet-processing type photosensitive materials can be decolored by a liquid treatment after the exposure. However, dry-processing type photosensitive materials cannot be subjected to the liquid treatment, thus, some proposals have been made for decoloring the colored layer in the dry-processing type photosensitive materials, for example:

(1) methods of using a colored layer comprising a heat-decoloring dye described in U.S. Pat. Nos. 3,769,019, 3,821,001, 4,033,948, 4,088,497, 4,153,463 and 4,283,487, Japanese Patent Laid-Open Nos. 52-139136, 53-132334, 54-56818, 57-16060 and 59-182436, etc., or a dye which is decolored by a corrosive gas generated from a counter salt under a heating condition described in U.S. Pat. No. 4,347,401, etc.;

(2) methods of using a colored layer comprising a thermally carbanion-generating agent and a dye to decolor the colored layer by heating, described in U.S. Pat. Nos. 5,135,842, 5,258,274, 5,314,795, 5,324,627 and 5,384,237, European Patent No. 605286, Japanese Patent Laid-Open Nos. 6-222504 and 7-199409, etc.;

(3) methods of using a colored layer comprising a photo-decoloring dye such as an o-nitroarylidene dye and an o-nitro-o-azarylidene dye described in U.S. Pat. No. 3,984,248 and Japanese Patent Laid-Open No. 54-17833, an N—O bond-cleavable dye described in U.S. Pat. No. 3,770,451, a chrominium type cyanine dye described in Japanese Patent Laid-Open No. 2-229864, an anionic dye having an indonium counter ion described in Japanese Patent Laid-Open No. 59-164549, etc.; and (4) methods of using a colored layer comprising a photosensitive halogen compound described in Japanese Patent Laid-Open Nos. 57-20734 and 57-68831, an azide compound described in Japanese Patent Laid-Open No. 63-146028, a ketone-based sensitizing compound described in Japanese Patent Laid-Open No. 50-10618, a meso ionic compound described in U.S. Pat. No. 4,548,895 or an indonium compound described in U.S. Pat. No. 4,701,402, and a dye which is decolored by reacting with active species generated by light-irradiating and/or heating these compounds, or by interacting with exited derivatives of these compounds.

In the methods of (1) and (2), the colored layer is decolored by heating, thus, the colored layer is easily decolored during thermal development. However, the colored layer used in the methods of (1) and (2) may be decolored during storage so that there is a case where it cannot act in the exposure process. For example, the photosensitive material for photographing is often stored under such a hard condition as in a car in the middle of summer, whereby there is a fear that the colored layer of the photosensitive material for photographing is decolored by the high temperature condition.

In the methods of (3) and (4), the colored layer is decolored by light. However, because decoloring in the methods of (3) and (4) demands a large amount of radiant ray, thermal developing photosensitive layer may be color-changed and long period of time is needed in decoloring the colored layer.

OBJECT AND SUMMARY OF THE INVENTION

An object of the present invention is to provide a photosensitive material having a colored layer, which exhibits an excellent stability even under hard storage conditions, and can be easily decolored if necessary. Another object of the present invention is to provide a method for forming an image using the photosensitive material.

As a result of intense research in view of the above objects, the inventor has found that a reversibly decolorable colored layer that is reversibly colored and decolored at particular temperature exhibits an excellent stability even under hard storage conditions and can be easily decolored if necessary. The present invention has been accomplished by the finding.

Thus, a photosensitive material of the present invention is such that comprises a substrate and a reversibly decolorable colored layer disposed thereon, wherein the reversibly decolorable colored layer is reversibly colored and decolored, the reversibly decolorable colored layer is in a colored state at 25° C., and a temperature at which the color density of the reversibly decolorable colored layer is reduced to 50% based on that at 25° C. is 50 to 120° C.

Hereinafter, this temperature of 50 to 120° C. is referred to as "decoloration initiation temperature." The reversibly decolorable colored layer used in the photosensitive material of the present invention is in a colored state around ordinary temperature at which the photosensitive material is used, thereby sufficiently acting as a filter layer, a antihalation layer, an irradiation-preventing layer, etc. In the case where the photosensitive material is stored under a high temperature condition, the reversibly decolorable colored layer may be decolored during the storage. Even in this case, the reversibly decolorable colored layer can be easily re-colored to exhibit its functions when the photosensitive material is put into practical use at a room temperature, and the reversibly decolorable colored layer can be easily re-decolored by heating when image information provided on the photosensitive material is read by a scanner, etc.

In the photosensitive material of the present invention, the reversibly decolorable colored layer preferably comprises: an electron-donating, organic color-former; a compound having a phenolic hydroxyl group; and at least one compound selected from the group consisting of alcohols, esters, ketones and ethers. Further, the photosensitive material preferably comprises a photosensitive layer comprising a silver halide, a dye-providing compound and a binder to be used as a silver halide photosensitive material for photographing. The photosensitive layer preferably further comprises an organic silver salt when the photosensitive material is used as a heat-developable photosensitive material (photothermographic material).

A method for forming an image of the present invention comprises the steps of: exposing the photosensitive material of the present invention; developing the exposed photosensitive material to provide an image information thereon; and reading the image information by a scanner at the above-mentioned decoloration initiation temperature or higher to produce an image data.

DETAILED DESCRIPTION OF THE PREFERRED EMBODIMENTS

[I] Photosensitive Material

A photosensitive material of the present invention comprises a substrate and a reversibly decolorable colored layer disposed thereon. The reversibly decolorable colored layer can be reversibly colored and decolored. The reversibly decolorable colored layer is in a colored state at 25° C., and the color density of the reversibly decolorable colored layer is reduced at least to some extent by heating. Thus, the color density of the reversibly decolorable colored layer used in the present invention is changed depending on the temperature. In the present invention, the decoloration initiation temperature is defined as a temperature at which the color density of the reversibly decolorable colored layer is reduced to 50% based on that at 25° C. while gradually heating the photosensitive material from 25° C. The decoloration initiation temperature defined in the present invention is 50 to 120° C. More specifically, the color density of the reversibly decolorable colored layer is evaluated by light absorptivity thereof toward a light of the maximum absorption wavelength in the visible wavelength range (400 to 700 nm), thus, the decoloration initiation temperature is a temperature such that this light absorptivity is reduced to half while gradually heating the photosensitive material from 25° C. Further, if the reversibly decolorable colored layer has "first color density" at 25° C., and it has "second color density" after the photosensitive material is heated from 25° C. to the decoloration initiation temperature to once decolor the reversibly decolorable colored layer and then cooled down to 25° C. to color the reversibly decolorable colored layer again, the term "the reversibly decolorable colored layer is reversibly colored and decolored" means that the second color density is 80% or more of the first color density.

The reversibly decolorable colored layer used in the photosensitive material of the present invention is in a colored state around ordinary temperature at which the photosensitive material is used, thereby sufficiently acting as a filter layer, a antihalation layer, an irradiation-preventing layer, etc. In the case where the photosensitive material is stored under a high temperature condition, the reversibly decolorable colored layer may be decolored during the storage. Even in this case, the reversibly decolorable colored layer can be easily re-colored to exhibit its functions when the photosensitive material is put into practical use at a room temperature, and the reversibly decolorable colored layer can be easily re-decolored by heating when image information provided on the photosensitive material is read by a scanner, etc.

The photosensitive material of this invention generally comprises at least a photosensitive layer disposed by applying a silver halide emulsion on the substrate. Further, the photosensitive material may comprise photo-insensitive layers such as a protective layer, an undercoat layer, an intermediate layer, a yellow filter layer, an antihalation layer, etc. Auxiliary layers such as a back layer may be disposed on the back surface of the substrate.

The reversibly decolorable colored layer mentioned above may act as the photosensitive layer, the intermediate layer, the protective layer, the antihalation layer, the back layer, etc., and it may be applied to a combination of these layers. The reversibly decolorable colored layer preferably acts as the filter layer (the intermediate layer) and/or the antihalation layer.

The photosensitive material of the present invention preferably comprises at least one photosensitive unit composed of a laminate of a high-photosensitive emulsion layer and a low-photosensitive emulsion layer, which have substantially the same color sensitivity and different photosensitivity. In the case where the photosensitive material is used for color photographing, in general, it is preferable that the material comprises a photosensitive unit having red-sensitivity, a photosensitive unit having green-sensitivity and a photosensitive unit having blue-sensitivity, which are arranged in this order from the substrate side.

Each layers of the photosensitive material according to the present invention will be described in detail below. Incidentally, although the reversibly decolorable colored layer will be described separately from the other layers, the reversibly decolorable colored layer may acts as any of the other layers such as the photosensitive layer, the intermediate layer, etc.

(A) Reversibly Decolorable Colored Layer

The reversibly decolorable colored layer preferably comprises: an electron-donating, organic color-former; a compound having a phenolic hydroxyl group; and at least one decoloring compound selected from the group consisting of alcohols, esters, ketones and ethers. The reversibly decolorable colored layer may act as the photosensitive layer, the intermediate layer, the protective layer, the antihalation layer, the back layer, etc., and it may be applied to a combination of these layers. The reversibly decolorable colored layer preferably acts as the filter layer (the intermediate layer) and/or the antihalation layer.

(1) Electron-Donating, Organic Color-Former

The electron-donating, organic color-former used in the present invention is not limited in particular, and various compounds including known organic color-formers may be used in the present invention. The known organic color-formers are disclosed in: Moriga and Yoshida, "Senryo to Yakuhin (Dyes and Chemicals)", 9, Page 84 (Kaseihin Kogyo Kyokai, 1964); "Shinpan Senryo Binran (Handbook of Dyes, New Eddition)", Page 242 (Maruzen 1970); R. Gamer, "Reports on the Progress of Appl. Chem.", 56, Page 199 (1971); "Senryo to Yakuhin (Dyes and Chemicals)", 19, Page 230 (Kaseihin Kogyo Kyokai, 1974); "Shikizai (Coloring Matters)", 62, Page 288 (1989); "Senryo Kogyo (Dyeing Industry)", 32, Page 208; etc.

The electron-donating, organic color-former is classified into several series in accordance with its structure. The electron-donating, organic color-former used in this invention is preferably selected from the group consisting of diarylphthalide compounds, fluoran compounds, indolylphthalide compounds, acylleucoazine compounds, leuco auramine compounds, spiropyran compounds, rhodamine lactam compounds, triarylmethane compounds and chromene compounds. Typical specific examples of the electron-donating, organic color-formers used for the photosensitive material of the present invention are illustrated below.

(a) Diarylphthalide Compounds (1)

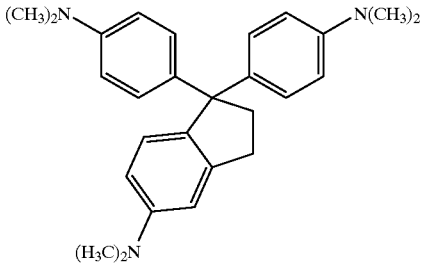

(2)

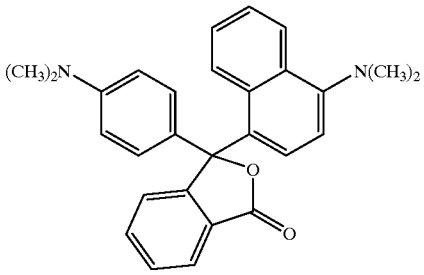

(3)

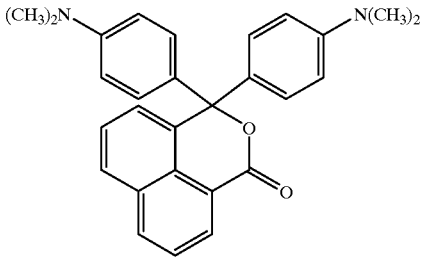

-continued (4)

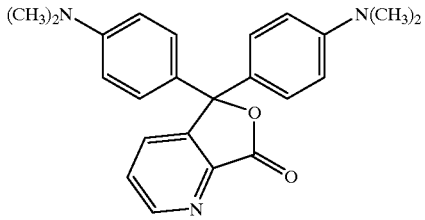

(b) Fluoran Compounds (5)

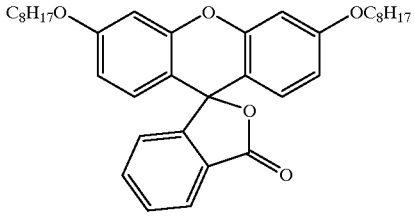

(6)

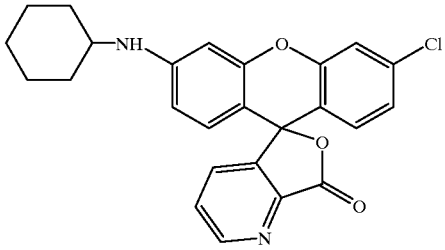

(7)

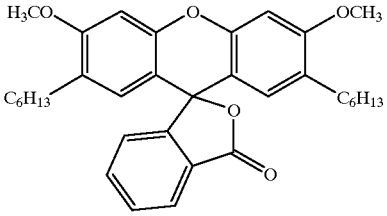

(8)

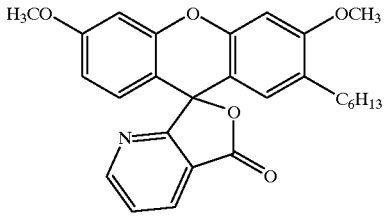

(9)

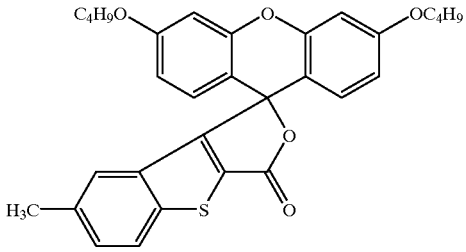

-continued
(10)
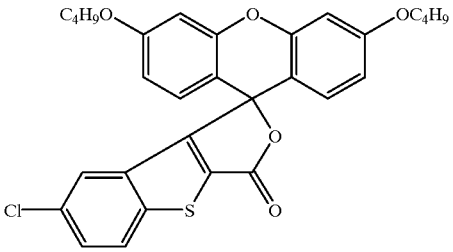
(11)
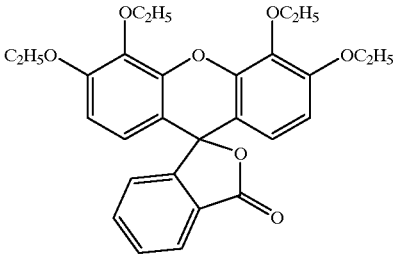
(12)
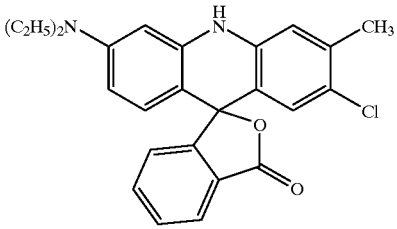
(13)
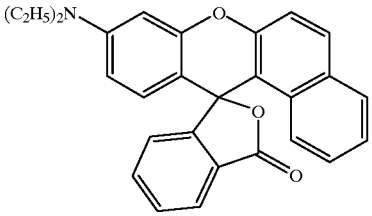
(14)
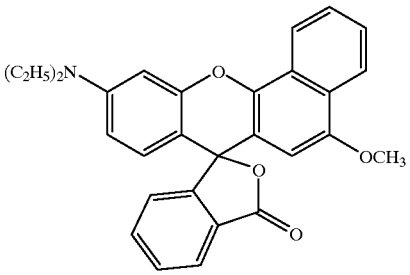
(15)
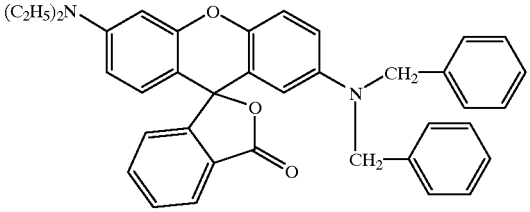
-continued
(16)
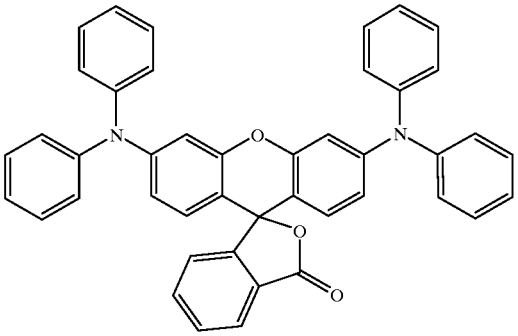
(17)
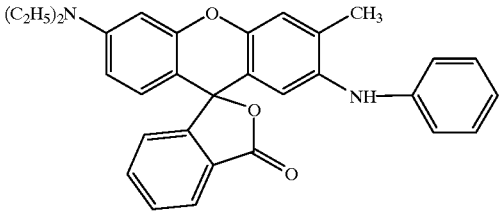
(18)
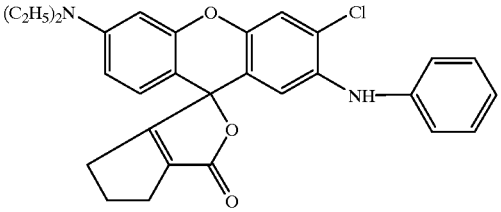
(19)
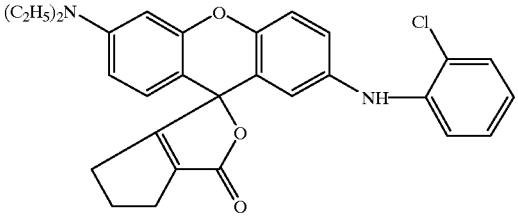
(20)
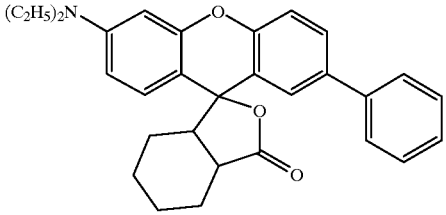
(21)
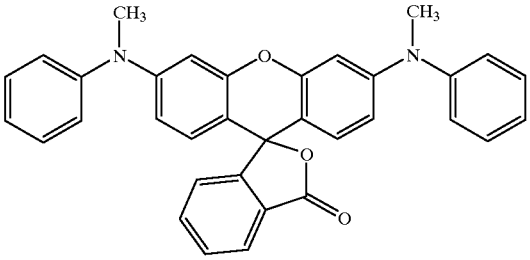

-continued
(c) Indolylphthalide Compounds
(22)
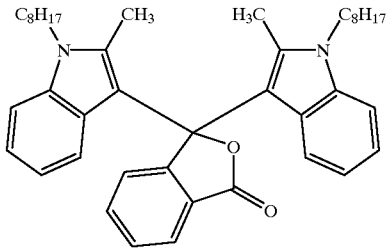
(23)
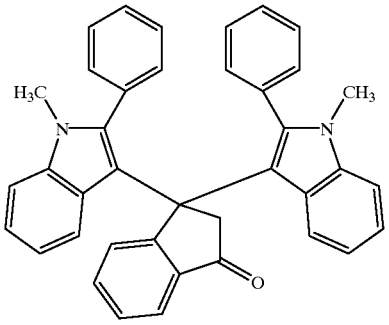
(24)
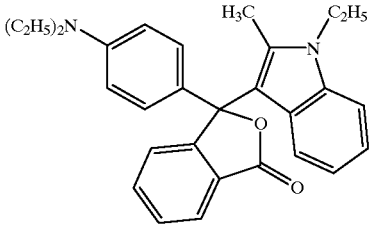
(25)
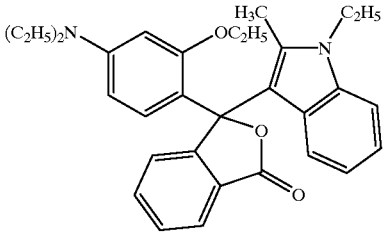
(26)
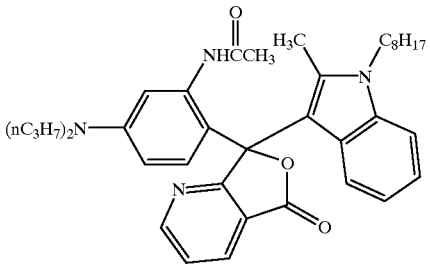
-continued
(27)
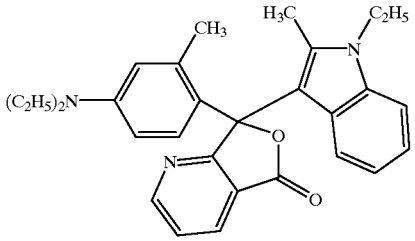
(28)
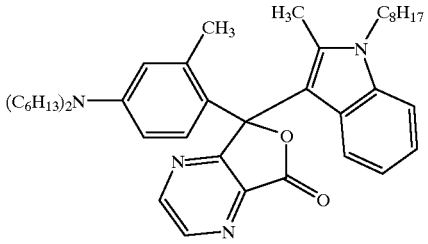
(29)
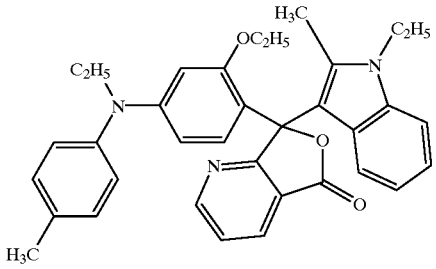
(30)
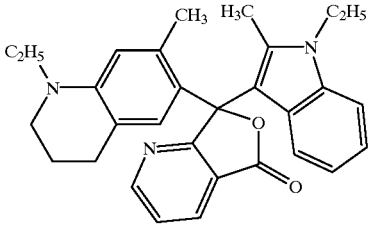
(31)
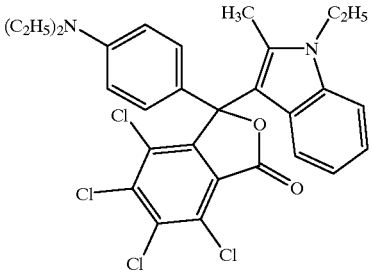

-continued
(d) Acylleucoazine Compounds
(32)
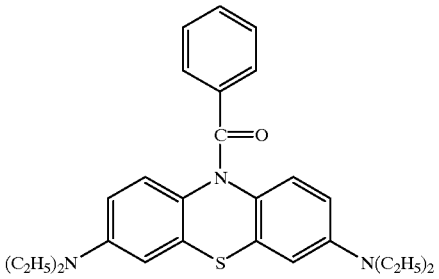
(33)
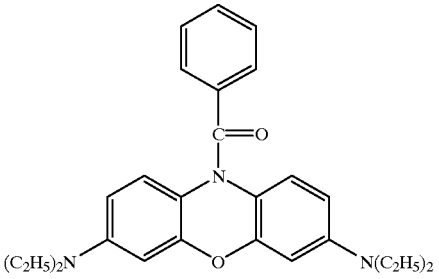
(34)
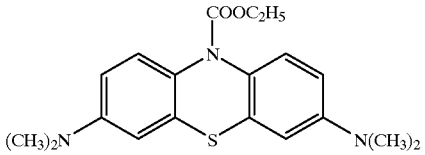
(35)
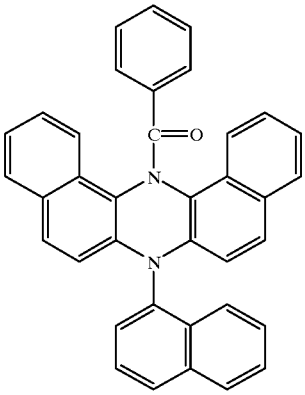
(e) Leuco Auramine Compounds
(36)
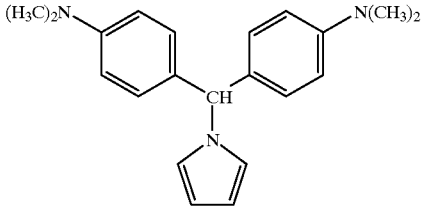
-continued
(37)
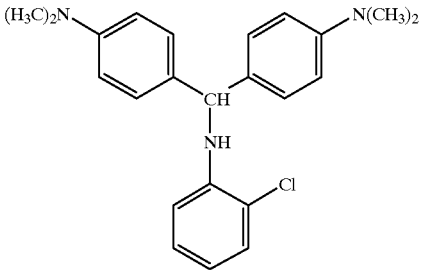
(38)
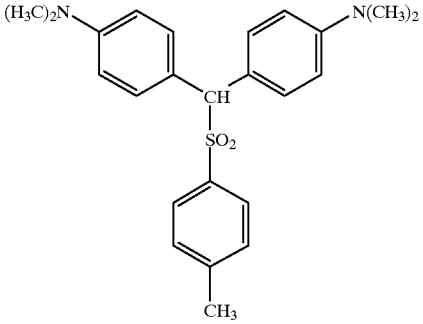
(39)
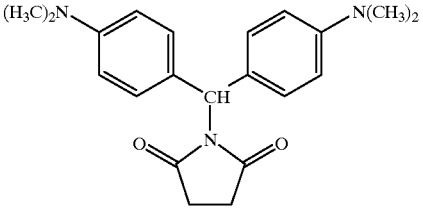
(f) Spiropyran Compounds
(40)
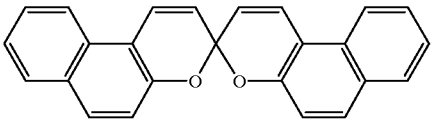
(41)
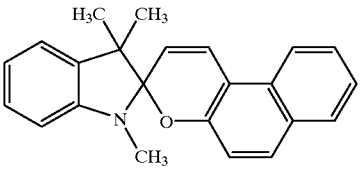
(g) Rhodamine Lactam Compounds
(42)
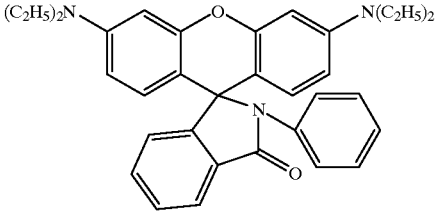

-continued
(43)
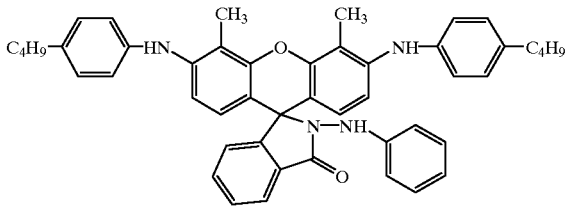
(h) Triarylmethane Compounds
(44)
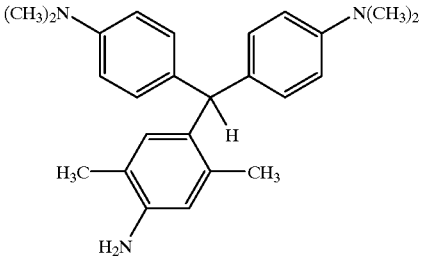
(45)
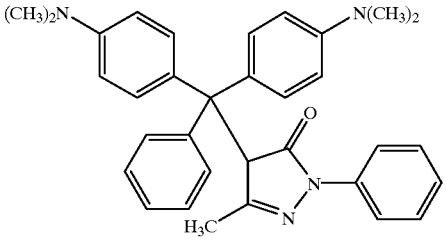
(46)
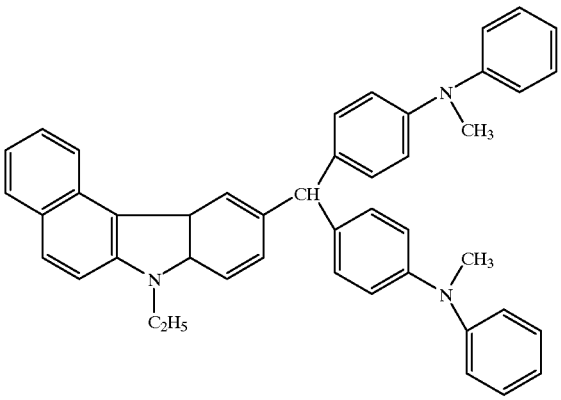
(47)
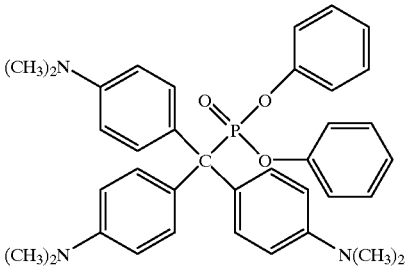
-continued
(i) Chromene Compounds
(48)
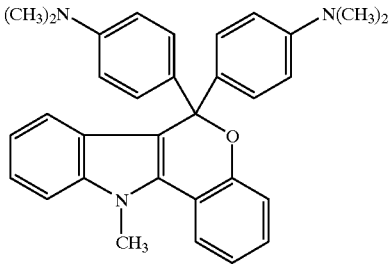
(49)
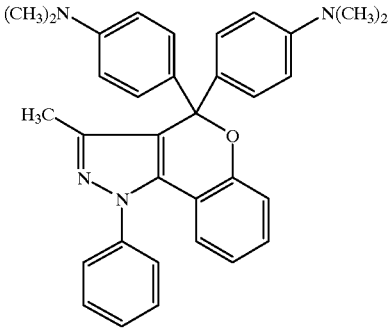
(50)
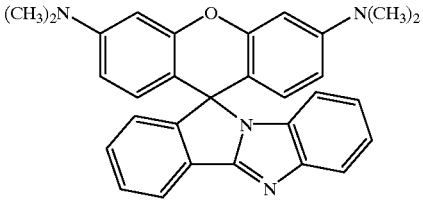
(j) Others
(51)
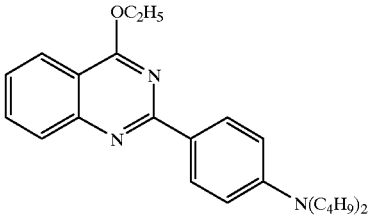
(52)
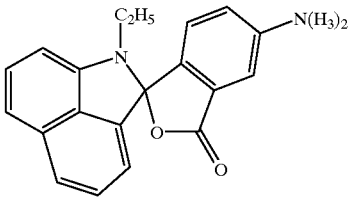

-continued (53)

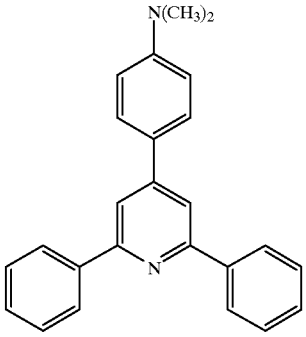

Recently, laser light sources such as semniconductor laser sources have rapidly spread. When the laser light sources are used, used as the electron-donating, organic color-former may be such that is colored by a light of more than 620 nm.

Examples of such an electron-donating, organic color-former include: 2,6-diaminofluoran compounds having a cyclic structure at the 2- and 3-positions disclosed in Japanese Patent Laid-Open Nos. 3-14878, 3-244587 and 4-173288; fluoran compounds having a substituent comprising p-phenylenediamine moiety disclosed in Japanese Patent Laid-Open Nos. 61-284485 and 3-239587; thiofluoran compounds disclosed in Japanese Patent Laid-Open No. 52-106873; 3,3-bis(4-substituted aminophenyl)azaphthalide compounds disclosed in Japanese Patent Laid-Open Nos. 5-139026 and 5-179151; phthalide compounds having a vinyl group disclosed in Japanese Patent Publication Nos. 58-5940, 58-27825 and 62-24365; fluorene compounds disclosed in Japanese Patent Laid-Open Nos. 63-94878 and 3-202386; sulfonylmethane compounds having a vinyl group disclosed in Japanese Patent Laid-Open Nos. 60-230890 and 60-231766; and compounds having a phenothiazine ring or a phenoxazine ring disclosed in Japanese Patent Laid-Open No. 63-199268. Specific examples of such an electron-donating, organic color-former will be illustrated below.

(54)

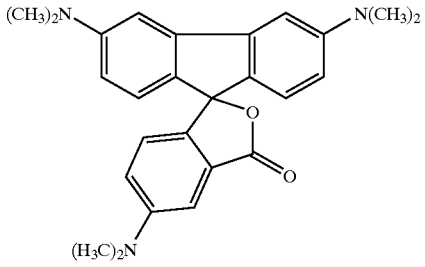

(55)

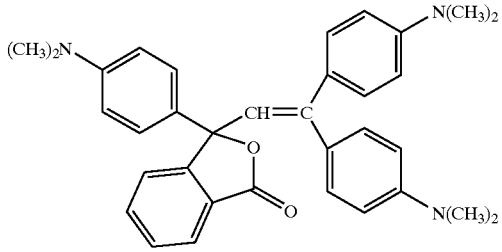

(56)

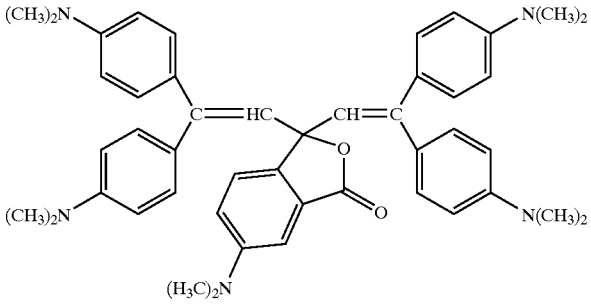

(57)

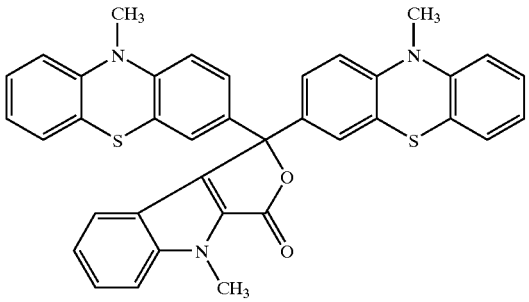

(58)

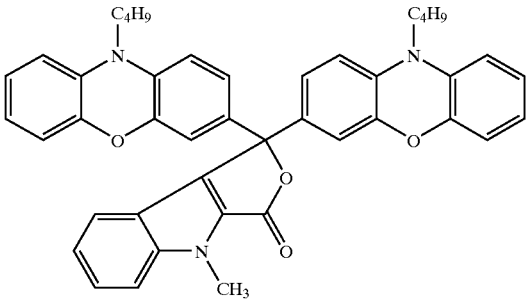

-continued
(59)
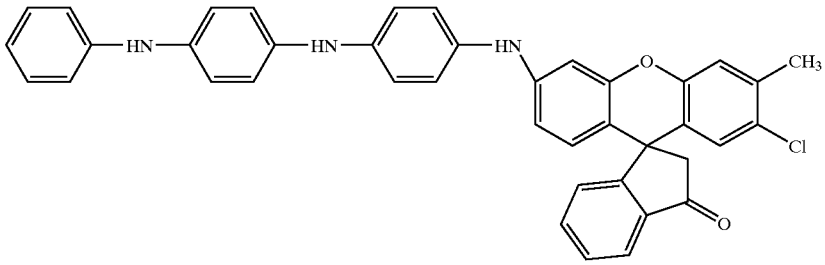
(60)
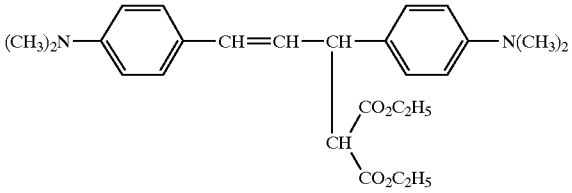
(61)
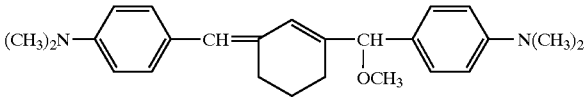
(62)
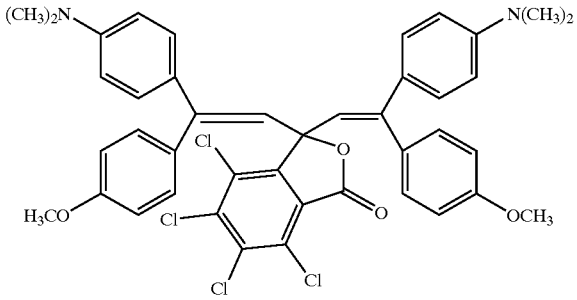
(63)
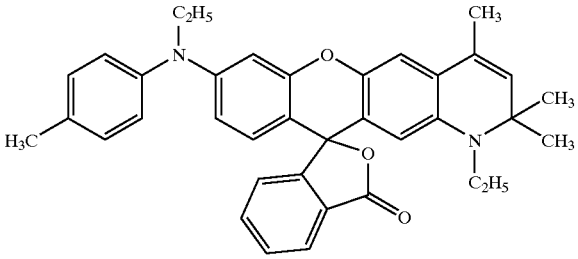
(64)
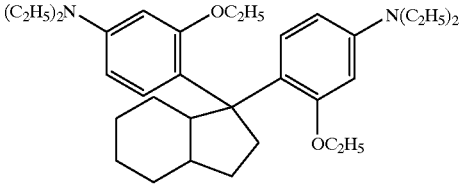
(65)
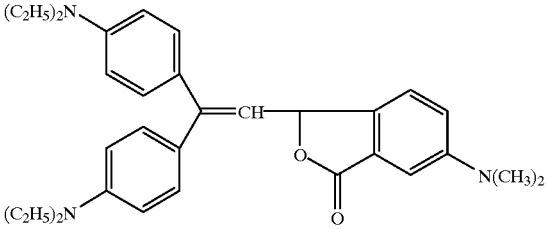
(66)
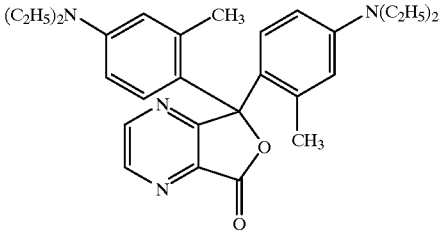

-continued (67)

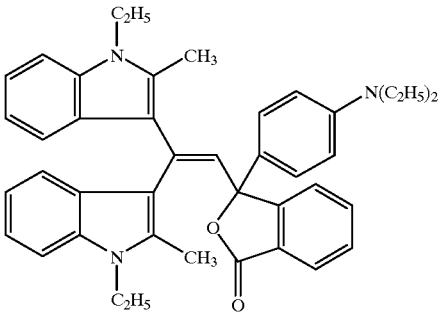

The electron-donating, organic color-former used in the present invention is not limited to the above specific examples, and may be used singly or in combination with each other.

(2) Compound Having Phenolic Hydroxyl Group

The compound having a phenolic hydroxyl group used for the reversibly decolorable colored layer acts as a developer. Hereinafter, the compound having a phenolic hydroxyl group is referred to as "phenol-based developer." The phenol-based developer may have a plurality of phenolic hydroxyl groups, and may have a substituent on its benzene ring such as an alkyl group, an aryl group, an acyl group, an alkoxycarbonyl group, carboxyl group, an ester group, an amide group, a halogen atom, etc. The phenol-based developer may have a bisphenol structure or a triphenol structure.

Examples of the phenol-based developer include phenol, o-cresol, t-butylphenol, nonylphenol, n-octylphenol, n-dodecylphenol, n-stearylphenol, p-chlorophenol, p-bromophenol, o-phenylphenol, n-butylp-hydroxybenzoate, n-octyl p-hydroxybenzoate, n-dodecyl p-hydroxybenzoate, resorcin, dodecyl gallate, 2,2'-bis(4'-hydroxyphenyl)propane, 4,4'-dihydroxydiphenylsulfone, 1,1-bis(4'-hydroxyphenyl)ethane, 2,2-bis(4'-hydroxy-3-methylphenyl)propane, bis(4'-hydroxyphenyl)methane, bis(4'-hydroxyphenyl)sulfide, 1-phenyl-1,1-bis(4'-hydroxyphenyl)ethane, 1,1-bis(4'-hydroxyphenyl)-3-methylbutane, 2,2-bis(4'-hydroxyphenyl)butane, 2,2-bis(4'-hydroxyphenyl)ethylpropionate, 2,2-bis(4'-hydroxyphenyl)-4-methylpentane, 1,1-bis(4'-hydroxyphenyl)-2-methylpropane, 2,2-thiobis(6-t-butyl-3-methylphenol), 2,2-bis(4'-hydroxyphenyl)hexafluoropropane, 1,1-bis(4'-hydroxyphenyl)-n-pentane, 1,1-bis(4'-hydroxyphenyl)-n-hexane, 1,1-bis(4'-hydroxyphenyl)-n-heptane, 1,1-bis(4'-hydroxyphenyl)-n-octane, 1,1-bis(4'-hydroxyphenyl)-n-nonane, 1,1-bis(4'-hydroxyphenyl)-n-decane, 1,1-bis(4'-hydroxyphenyl)-n-dodecane, 2,2-bis(4'-hydroxyphenyl)-n-heptane, 2,2-bis(4'-hydroxyphenyl)-n-nonane, 1,1-bis(4'-hydroxyphenyl)-4-methylbutane, 1,1-bis(3'-methyl-4'-hydroxyphenyl)-n-hexane, etc. These phenol-based developers may be used singly or in combination with each other.

(3) Decoloring Compound

The reversibly decolorable colored layer preferably comprises at least one decoloring compound selected from the group consisting of alcohols, esters, ketones and ethers. These decoloring compound act to decolor the reversibly decolorable colored layer at a high temperature.

(a) Alcohols

Examples of alcohol used as the decoloring compound include: decane-1-ol; undecane-1-ol; lauryl alcohol; tridecane-1 -ol; myristyl alcohol; pentadecane-1-ol; cetyl alcohol; heptadecane-1-ol; stearyl alcohol; octadecane-2-ol; eicosane-1-ol; decosane-1-ol; 6-(perfluoro-7-methyloctyl) hexanol; cyclododecanol; 4,1-cyclohexanediol; 1,2-cyclohexanediol; 1,2-cyclododecanediol; sterol compounds such as cholesterol, stigmasterol, pregnolone, methylandrostenediol, estradiol benzoate, epiandrostene, stenolone, β-sitosterol, pregnenolone acetate, β-cholestarol, 5,16-pregnadiene-3β-ol-20-one, 5α-pregnene-3β-ol-20-one, 5-pregnene-3β,17-diol-20-one 21-acetate, 5-pregnene-3β, 17-diol-20-one 17-acetate,5-pregnene-3β,21-diol-20-one 21-acetate, 5-pregnene-3β,17-diol diacetate, trockogenin, rockogenin tigogenin, smilagenin, hecogenin and diosgenin; saccharides and derivatives thereof such as glucose and saccharose; alcohols having a cyclic structure such as 1,2:5, 6-diisopropylidene-D-mannitol; etc.

(b) Esters

Esters used as the decoloring compound may be: (i) esters having 10 or more carbon atoms, derived from a mono-valent fatty acid and an aliphatic or alicyclic mono-valent alcohol; (ii) polybasic acid esters having 2 or more carbon atoms, derived from an aliphatic di- or poly-valent carboxylic acid and an aliphatic or alicyclic mono-valent alcohol; (iii) esters having 26 or more carbon atoms, derived from a mono-valent fatty acid and an aliphatic di- or poly-valent alcohol; (iv) esters having 28 or more carbon atoms, derived from a mono-valent fatty acid and an aromatic divalent alcohol; etc.

Examples of esters of (i) include ethyl caprylate, n-butyl caprylate, n-octyl caprylate, lauryl caprylate, cetyl caprylate, stearyl caprylate, n-hexyl caprylate, myristyl caprylate, docosyl caprylate, methyl laurate, 2-ethylhexyl laurate, n-decyl laurate, stearyl laurate, ethyl myristate, 3-methylbutyl myristate, 2-methylpentyl myristate, n-decyl myristate, cetyl myristate, stearyl myristate, isopropyl palmitate, neopentyl palmitate, n-nonyl palmitate, n-undecyl palmitate, lauryl palmitate, myristyl palmitate, cetyl palmitate, stearyl palmitate, cyclohexyl palmitate, cyclohexylmethyl palmitate, methyl stearate, ethyl stearate, n-propyl stearate, n-butyl stearate, n-amyl stearate, 2-methylbutyl stearate, n-hexyl stearate, n-heptyl stearate, 3,5,5-trimethylhexyl stearate, n-octyl stearate, 2-ethylhexyl stearate, n-nonyl stearate, n-decyl stearate, n-undecyl stearate, lauryl stearate, n-tridecyl stearate, myristyl stearate, n-pentadecyl stearate, cetyl stearate, stearyl stearate, eicosyl stearate, n-dococyl stearate, cyclohexyl stearate, cyclohexylmethyl stearate, oleyl stearate, isostearyl stearate, n-butyl 1,2-hydroxystearate, methyl behenate, ethyl behenate, n-propyl behenate, isopropyl behenate, n-butyl behenate, isobutyl behenate, 2-methylbutyl behenate, n-amyl behenate, neopentyl behenate, n-hexyl behenate, 2-methylpentyl behenate, n-heptyl behenate, 2-ethylhexyl behenate, n-nonyl behenate, myristyl behenate, n-undecyl behenate, lauryl behenate, n-tridecyl behenate, n-pentadecyl behenate, cetyl behenate, stearyl behenate, behenyl behenate, etc.

Examples of esters of (ii) include dimyristyl oxalate, cetyl oxalate, dilauryl malonate, dicetyl malonate, distearyl malonate, dilauryl succinate, dimyristyl succinate, dicetyl succinate, distearyl succinate, dilauryl glutarate, diundecyl adipate, dilauryl adipate, di-n-tridecyl adipate, dimyristyl adipate, dicetyl adipate, distearyl adipate, di-n-dodecyl adipate, di-n-decyl azelate, dilauryl azelate, di-n-tridecyl azelate, di-n-nonyl sebacate, dimyristyl sebacate, distearyl sebacate, di-n-pentyl 1,18-octadecylmethylenedicarbonate, di-n-octyl 1,18-octadecylmethylene-dicarbonate, di-(cyclohexylmethyl) 1,18-octadecylmethylene-dicarbonate, di-neopentyl 1,18-octadecylmethylene-dicarbonate, di-n-hexyl 1,18-octadecylmethylene-dicarbonate, di-n-heptyl 1,18-octadecylmethylene-dicarbonate and di-n-octyl 1,18-octadecylmethylene-dicarbonate, etc.

Examples of esters of (iii) include ethyleneglycol dimyristylate, ethyleneglycol dipalmitate, ethyleneglycol distearate, propyleneglycol dilaurate, propyleneglycol dimyristate, propyleneglycol dipalmitate, butyleneglycol distearate, hexyleneglycol dilaurate, hexyleneglycol dimyristate, hexyleneglycol dipalmitate, hexyleneglycol distearate, 1,5-pentanediol distearate, 1,2,6-hexanetriol dimyristate, pentaerythritol trimyristate, pentaerythritol tetralaurate, 1,4-cyclohexanediol didecyl, 1,4-cyclohexanediol dimyristyl, 1,4-cyclohexanediol distearyl, 1,4-di(hydroxymethyl)-cyclohexane dilaurate, 1,4-di (hydroxymethyl)-cyclohexane dimyristate, etc.

Examples of esters of (iv) include xyleneglycol dicaprate, xyleneglycol di-n-undecanate, xyleneglycol dilaurate, xyleneglycol dimyristate, xyleneglycol dipalmitate, xyleneglycol distearate, etc.

(c) Ketones

Ketone used as the decoloring compound has 10 or more carbon atoms, and examples thereof include decane-2-one, undecane-2-one, laurone, stearone, etc.

(d) Ethers

Examples of alcohol used as the decoloring compound include dibutyl ether, dihexyl ether, diisopropylbenzyl ether, diphenyl ether, dioxane, ethyleneglycol dibutyl ether, diethyleneglycol dibutyl ether, ethyleneglycol diethyl ether, diethyleneglycol diethyl ether, ethyleneglycol diphenyl ether, etc.

The decoloring compounds may be used singly or in combination with each other.

(4) Composition of Reversibly Decolorable Colored Layer

Amount of the electron-donating, organic color-former per 1 $m^2$ of the reversibly decolorable colored layer is preferably 0.01 to 10 mmol/$m^2$, more preferably 0.05 to 5 mmol/$m^2$.

Weight ratio of the phenol-based developer is preferably 0.1 to 10 part by weight, more preferably 1 to 4 part by weight, to 1 part by weight of the electron-donating, organic color-former. When the weight ratio of the phenol-based developer is less than 0.1 part by weight, the reversibly decolorable colored layer cannot be sufficiently colored by interaction between the electron-donating, organic color-former and the phenol-based developer. On the other hand, when the weight ratio is more than 10 parts by weight, the interaction therebetween cannot be sufficiently inhibited.

Weight ratio of the decoloring compound is preferably 1 to 200 part by weight, more preferably 2 to 100 parts by weight, to 1 part by weight of the electron-donating, organic color-former. When the weight ratio of the decoloring compound is less than 1 part by weight, it becomes difficult to decolor the reversibly decolorable colored layer. On the other hand, if the weight ratio exceeds 200 parts by weight, it becomes difficult to color the reversibly decolorable colored layer reversibly.

The electron-donating, organic color-former and the phenol-based developer should be mixed to develop a color before the reversibly decolorable colored layer is formed. Although the decoloring compound may be mixed with the color-producing compound and the phenol-based developer beforehand, the decoloring compound may be added to the reversibly decolorable colored layer separately therefrom and mixed therewith when the reversibly decolorable colored layer is heated.

In the photosensitive material of the present invention, the color-producing compound, the phenol-based developer and the decoloring compound are uniformly mixed at a high temperature, whereby the phenol-based developer and the decoloring compound interact with each other to decolor the reversibly decolorable colored layer. In contrast with this, the phenol-based developer seems to interact with the color-producing compound more strongly than with the decoloring compound at a low temperature, thereby coloring the reversibly decolorable colored layer.

A method for adding each of the color-producing compound, the phenol-based developer and the decoloring compound to the reversibly decolorable colored layer is not particularly limited. In the reversibly decolorable colored layer, it is particularly preferable that fine particles including the color-producing compound, the phenol-based developer and the decoloring compound are dispersed in a hydrophilic binder such as gelatin, PVA, etc. The fine particles may be in form of a capsule.

In the present invention, the term "the reversibly decolorable colored layer is decolored" means that the color density of the reversibly decolorable colored layer is reduced to half or less of the initial color density. When the reversibly decolorable colored layer is once decolored, and then colored again, the color density of the re-colored, reversibly decolorable colored layer is 80% or more of the initial color density. The decoloring period, for which the color density of the reversibly decolorable colored layer reaches in equilibrium after it is heated to the decoloration initiation temperature or higher, is preferably 10 seconds or less. Further, the re-coloring period, for which the color density of the reversibly decolorable colored layer reaches in equilibrium after it is once decolored and cooled down to a temperature less than the decoloration initiation temperature, is preferably 5 minutes or less. The kinds and amounts of the electron-donating, organic color-former, the phenol-based developer and the decoloring compound are selected in view of satisfying the above conditions.

(B) Photosensitive Layer

To use the photosensitive material of the present invention as a silver halide photosensitive material for photographing, the photosensitive material preferably comprises a photosensitive layer comprising a silver halide, a dye-providing compound and a binder. Further, the photosensitive layer preferably comprises an organic silver salt when the photosensitive material is used as a heat-developable photosensitive material (photothermographic material). Components of the photosensitive layer will be described below.

(1) Silver Halide Emulsion (a) Photosensitive Silver Halide

Halogen composition of the silver halide used for the photosensitive layer is not limited in particular, and may be selected in accordance with the desired properties. The silver halide may be silver chloride, silver chlorobromide, silver bromide, silver iodobromide, silver iodochlorobromide, etc. To increase the sensitivity of the photosensitive material for photographing, silver bromide or silver iodobromide is preferably used for the photosensitive layer. A so-called "high silver chloride emulsion" that includes 50 mole % or more, preferably 80 mole % or more of silver chloride can reduce haze provided on the photosensitive material after development, to be also preferably used for the photosensitive layer. A method for preparing grains of the photosensitive silver halide is not particularly limited, for example, the grains may be prepared by a method disclosed in Japanese Patent Laid-Open No. 11-119374, paragraphs 217 to 224.

The silver halide grains may be a cube, an octahedron, a tetradecahedron, tabular, a sphere, a cylinder, a potato, etc. in shape. The silver halide grains are preferably cubic or tabular in shape. Embodiments of the silver halide grains with respect to aspect ratio, indices of crystal plane, etc. may be the same as those disclosed in Japanese Patent Laid-Open No. 11-119374, paragraph 225.

The grain size distribution of the silver halide grains is preferably monodispersed. The coefficient of variation according to the grain size distribution is preferably 40% or less, more preferably 30% or less, particularly preferably 20% or less.

In the case of using the photosensitive material of the present invention for photographing, the silver halide emulsion should have a sensitivity sufficient for photography. The sensitivity of the silver halide emulsion is substantially in proportion to a light-receiving area of the silver halide grains, i.e., a projected area thereof.

Particularly, because the amount of development reaction caused around the development-initiating point in the heat-developable photosensitive material is more limited than that of a conventional liquid-developable photosensitive material, it is preferred that the number of the development-initiating point per the unit area of the material is increased to provide an image having a sufficient color density. Although it is effective that the number of the silver halide grains per the unit area of the photosensitive material is increased in order to increase the number of the development-initiating point, there is a problem that this results in large volume of the silver halide grains. In particular, the problem becomes serious in the case of using sufficiently sensitive silver halide grains having a relatively large size of approximately 0.4 to 2 $\mu$m in terms of equivalent spherical diameter. Thus, the tabular grains are preferably used, which has a small grain volume to the light-receiving area.

The tabular grain is represented with regard to its shape by a so-called "aspect ratio", which is obtained by dividing the diameter of a circle equivalent to the projected area of the grain by the thickness of the grain. Assuming that each of the silver halide grains has the same sensitivity, the aspect ratio is preferably made larger, whereby the number of the silver halide grains per silver amount is increased.

The silver halide emulsion used for the photosensitive material of the present invention is preferably composed of silver halide grains where the tabular silver halide grains occupy at least 50% of the total projected area of the silver halide grains, the thickness of the tabular silver halide grains being 0.3 $\mu$m or less, preferably 0.2 $\mu$m or less and the aspect ratio of the tabular silver halide grains being 2 to 100, preferably 8 to 80. Such a silver halide emulsion is excellent in sensitivity and graininess even if the amount of the silver is small. The thickness of the silver halide grain is more preferably 0.15 $\mu$m or less, particularly preferably 0.10 $\mu$m or less. If all the silver halide emulsions are composed of such silver halide grains, the effects of the present invention are particularly outstandingly obtained. The silver halide grain having such a relatively small grain size that is approximately 0.5 $\mu$m or less of a diameter of a sphere equivalent thereto in volume preferably has 25 or more of a tabularity obtained by dividing the aspect ratio of the silver halide grain by the thickness thereof.

The coefficient of variation according to the thickness distribution of the silver halide grains is preferably 40% or less, more preferably 30% or less, particularly preferably 20% or less.

Using methods and properties of the tabular silver halide grain high in the aspect ratio are disclosed in U.S. Pat. Nos. 4,433,048, 4,434,226 and 4,439,520, etc. Further, the tabular silver halide grains extremely high in the aspect ratio having a thickness of less than 0.07 $\mu$m are disclosed in U.S. Pat. Nos. 5,494,789, 5,503,970, 5,503,971 and 5,536,632, European patent Nos. 699945, 699950, 699948, 699944, 701165 and 699946, etc. To prepare the thinner, tabular silver halide grains high in the aspect ratio, it is important that nucleation is taken place while controlling the binder concentration, temperature, pH, kinds and concentration of excess halide ion, feed rate of the reaction liquid, etc. In addition, it is important that a reaction liquid for grain growth is added while controlling the adding rate and a binder used from the nucleation to grain growth process is appropriately selected, to selectively grow the nuclei not in the direction of the thickness but in the direction toward the periphery. In this case, the binder is preferably a gelatin low in methionine-content or a gelatin having an amino group modified with phthalic acid, trimellitic acid, pyromellitic acid, etc.

The silver halide grain may be prepared to have a various structures or compositions. Typically used is, for example, the silver halide grain having a halogen composition changed stepwise or continuously. Silver iodobromide grains having a core/shell structure in which layers different in iodine-content are laminated are preferably used in the photosensitive material for photographing. The core/shell grain preferably has 2- to 5-layered structure, more preferably has 2- to 4-layered structure.

Known as the core/shell grain are: a so-called inside-high-iodine-type core/shell grain where a core high in the iodine-content is covered with a shell low in the iodine-content to control the developability of the photosensitive material; an outside-high-iodine-type core/shell grain where a core is covered with a shell high in the iodine-content to improve shape-stability of the grain in the case where the thickness thereof is reduced; etc.

Also known is a silver halide grain where a core low in the iodine-content is covered with the first layer high in the iodine-content and the second layer low in the iodine-content is deposited on the first layer, to increase the sensitivity of the grain. In this silver halide grain, on the second layer is formed a dislocation line due to crystal disorder to increase the sensitivity, the second layer being corresponding to the fringes of the outer edge portion in the tabular grain.

The layer high in the iodine-content is preferably deposited by: a method of adding a solution of a water-soluble iodide such as potassium iodide singly or together with a solution of a water-soluble silver salt such as silver nitrate; a method of introducing silver iodide fine grains; a method of adding a compound capable of releasing an iodide ion by reacting with an alkali or a nucleophilic reagent such as sodium p-iodinated acetamidobenzene sulfonate; etc.

In this invention, on the silver halide grain may be deposited epitaxial protrusion. Amount of silver in the photosensitive silver halide per 1 $m^2$ of the photosensitive material is preferably 1 to 20 $g/m^2$, more preferably 2 to 10 $g/m^2$.

(b) Preparation of Photosensitive Silver Halide

The photosensitive silver halide grains may be prepared referring to methods disclosed in: P. Glafkides, "Chimie et Phisique Photographique", Paul Montel, 1967; G. F. Duffin, "Photographic Emulsion Chemistry", Focal Press, 1966; V. L. Zelikman et al., "Making and Coating of Photographic Emulsion", Focal Press, 1964; etc.

The silver halide grains used in the present invention is generally prepared by adding a solution comprising a water-soluble silver salt such as silver nitrate and a solution comprising a water-soluble halide such as a alkali halide to an aqueous solution comprising a water-soluble binder such as gelatin. The silver halide grains may be prepared under any pH condition by an acid process, a neutral process, an ammonia process, etc. Reaction solutions, the solution comprising a water-soluble silver salt and the solution comprising a water-soluble halide, is preferably supplied by a single-jet method, a double-jet method, a combination thereof, etc. Also preferred is the controlled double-jet method, in which the rate of adding the reaction solution is controlled to maintain pAg of the reaction solution at a desired value. The pH value of the reaction solution may be uniformly kept during the reaction.

The silver halide grains may be prepared while controlling the solubility of the silver halide by changing the temperature, the pH value or the pAg value of the reaction mixture. Further, the silver halide grains may be prepared by methods using a thioether, a thiourea or a rhodanine as a solvent. These methods are disclosed in Japanese Patent Publication No. 47-11386, Japanese Patent Laid-Open No. 53-144319, etc.

After the preparation of the silver halide grains, the excess water-soluble salts are preferably removed. The excess water-soluble salts may be removed by: a noodle water-washing method where a gelatin solution comprising the silver halide grains are gelled and cut into strings, and then the water-soluble salts therein are washed away by cold water; a sedimentation method where to the gelatin solution is added an inorganic salt comprising a polyvalent anion such as sodium sulfate, an anionic surfactant, an anionic polymer such as sodium polystyrenesulfonate, a gelatin derivative such as an aliphatic acylated gelatin, an aromatic acylated gelatin and an aromatic carbamoylated gelatin, etc. to aggregate the gelatin, thereby removing the water-soluble salts; etc. The sedimentation method is preferred from the viewpoint of rapidity for removing the excess water-soluble salts.

(c) Chemical Sensitization

The silver halide grains are preferably doped with a polyvalent metal ion such as a transition metal ion, to improve the sensitivity and the dependency on exposure conditions of the photosensitive layer. Although the polyvalent metal ion may be added as a halide, a nitrate, etc. during preparation of the silver halide grains, the polyvalent metal ion is preferably added as a metal complex having a central metal of the polyvalent metal ion such as a halogeno complex, an ammine complex, a cyano complex, a nitrosyl complex, etc.

The metal complex is preferably composed of ions derived from the first, the second or the third transitional metal elements, and ligands such as a cyanide ion, which is able to seriously split the d orbital of the spectrochemical series. Preferable examples of the central transition metal in the metal complex include iron, cobalt, ruthenium, rhenium, osmium and iridium. The metal complex is preferably a six-coordinate complex where six ligands coordinate to the central metal in the octahedral form, and the six ligands preferably comprise four or more cyan ligands. Preferable examples of the ligand other than the cyan ligand include inorganic ligands such as SCN, NCS and $H_2O$, and organic ligands such as pyridine, bipyridine, phenanthroline, iridazole and pyrazole. Further examples of the preferred metal complex include: complexes of ruthenium, rhodium, palladium or iridium having a halide ion or a thiocyanate ion as a ligand; complexes of ruthenium having at least one nitrosyl ligand; complexes of chromium having a cyanide ion ligand; etc.

Further, it is preferable that the silver halide grains are doped with a divalent anion derived from a so-called chalcogen element such as sulfur, selenium and tellurium.

In the present invention, generally, it is preferable that the silver halide emulsion is chemically sensitized by a known chemical sensitization method. A plurality of the known chemical sensitization method may be used in combination with each other. The chemical sensitization increases the sensitivity of the silver halide grains, the exposure-condition stability and the storage stability.

Preferred as the chemical sensitization method is a chalcogen chemical sensitization method using a sulfur compound, a selenium compound or a tellurium compound. In the chalcogen chemical sensitization method, used as the sensitizer is a compound, which is added to the silver halide emulsion to release the chalcogen element, thereby forming a silver chalcogenide. A plurality of the sensitizers is preferably used in combination with each other to increase the sensitivity and to suppress the fogging to a low level.

Noble metal sensitization methods using gold, platinum, iridium, etc. are also preferable as the chemical sensitization method. In particular, gold sensitization methods using chlorauric acid provide high sensitivity. The chlorauric acid may be used singly or in combination with a thiocyanate ion that may coordinate to the gold central metal. The gold sensitization method is preferably used together with the chalcogen chemical sensitization method to further increase the sensitivity.

Reduction sensitization methods are also preferably used, where a compound having a suitable reducing ability is added to the silver halide grains to introduce reducing silver nuclei therein, thereby improving the sensitivity. An alkylamine compound having an aromatic ring, etc. is preferably used as the compound having a suitable reducing ability.

It is also preferable that a compound having an adsorptivity to the silver halide grains is used in the chemical sensitization to control the chemical sensitization reactivity. Particularly, the compound having the adsorptivity to the silver halide grains is preferably selected from the group consisting of nitrogen-comprising heterocyclic compounds, mercapto compounds, sensitizing dyes such as cyanine dyes and merocyanine dyes, and preferably added before the chemical sensitization such as the chalcogen chemical sensitization and the gold sensitization.

The conditions for the chemical sensitization may be selected in accordance with the purpose: the chemical sensitization temperature being generally 30 to 95° C., preferably 40 to 75° C.; the chemical sensitization pH value being generally 5.0 to 11.0, preferably 5.5 to 8.5; and the chemical sensitization pAg value being generally 6.0 to 10.5, preferably 6.5 to 9.8. Chemical sensitization techniques are disclosed in Japanese Patent Laid-Open Nos. 3-110555, 5-241267, 62-253159, 5-45833, 62-40446, etc. It is also preferred that an epitaxial extrusion is formed in the chemical sensitization.

(d) Photo-Insensitive Organic Silver Salt

A photo-insensitive organic silver salt may be used in combination with the photosensitive silver halide for the photosensitive layer. Particularly in the case of using the photosensitive material of the present invention as the heat-developable photosensitive material, the photosensitive layer preferably comprises the organic silver salt. The organic silver salt used in this invention is relatively stable to light, and supplies a silver ion by heating at 80° C. or higher under the presence of an exposed photocatalyst such as an latent image of the photosensitive silver halide and a reducing agent. Although the organic silver salt may be any organic salt that can be reduced and comprises a silver ion source, the organic silver salt is preferably an organic or inorganic complex comprising ligands having a complex-stability constant of 4.0 to 10.0.

The organic silver salt is also preferably a silver salt derived from an organic compound having a carboxyl group, which may be an aliphatic carboxylic acid or an aromatic carboxylic acid. Specific examples of the preferred aliphatic carboxylic acid include behenic acid, arachidic acid, stearic acid, oleic acid, lauric acid, caproic acid, myristic acid, palmitic acid, maleic acid, fimaric acid, tartaric acid, linoleic acid, butanoic acid, camphoric acid, combinations thereof, etc.

The silver aliphatic carboxylate preferably used as the organic silver salt may be prepared by reacting silver nitrate with a solution or a suspension comprising an alkali metal salt such as a sodium salt, a potassium salt and a lithium salt of the above-described aliphatic carboxylic acid. This method for preparing the silver aliphatic carboxylate is disclosed in Japanese Patent Laid-Open No. 2000-292882, Paragraph 19 to 21.

Although the shape and the size of the organic silver salt are not limited in particular, the organic silver salt preferably such that disclosed in Japanese Patent Laid-Open No. 2000-292882, Paragraph 24. The shape of the organic silver salt can be obtained by observing a dispersion comprising the organic silver salt by a transmission electron microscope.

It is preferred that the particle size distribution of the organic silver salt solid dispersion is mono-dispersion. A method of measuring a standard deviation of a volume weighted average diameter of the organic silver salt may be used to obtain the mono-dispersibility. The coefficient of variation, value of percentage obtained by dividing the standard deviation by the volume weighted average diameter, is preferably 80% or less, more preferably 50% or less, furthermore preferably 30% or less. To measure the standard deviation, for example, a grain size (volume weighted average diameter) may be obtained by the steps of: dispersing the organic silver salt in a liquid; exposing the resulting dispersion to a laser light; and measuring an autocorrelation functions to a change in time of fluctuation of the scattering light upon exposure. The average grain size of the organic silver salt used in this method is preferably 0.05 to 10.0 $\mu$m, more preferably 0.1 to 5.0 $\mu$m, furthermore preferably 0.1 to 2.0 $\mu$m.

The organic silver salt used in the present invention is preferably desalted. The desalting method is not particularly limited, and any known desalting methods may be used in the present invention. Among the known desalting methods, preferred are a centrifugal filtration method, a suction filtration method, an ultra filtration method, a flock-forming washing according to aggregation, etc. The ultra filtration method is disclosed in Japanese Patent Laid-Open No. 2000-305214, etc.

To prepare a solid organic silver salt dispersion that has a high S/N ratio and a small grain size, and is free from aggregation, a dispersing method is preferably used, where an aqueous dispersion comprising the organic silver salt as an image-forming medium and substantially no photosensitive silver salt is converted to a high speed fluid, and then, the aqueous dispersion is subjected to a pressure drop. The dispersing method is disclosed in Japanese Patent Laid-Open No. 2000-292882, Paragraph 27 to 38.

The organic silver salt solid dispersion comprises at least an organic silver salt and water. Although the weight ratio of the organic silver salt to water is not particularly limited, the weight ratio of the organic silver salt to the entire dispersion is preferably 5 to 50 weight %, particularly preferably 10 to 30 weight %. A dispersing agent is preferably used to prepare the organic silver salt dispersion. Amount of the dispersing agent is preferably as small as possible to lower the grain size of the organic silver salt, and weight ratio of the dispersing agent to the organic silver salt is preferably 0.5 to 30 weight %, particularly preferably 1 to 15 weight %.

Amount of silver in the organic silver salt per 1 $m^2$ of the photosensitive layer is preferably 0.1 to 10 $g/m^2$, more preferably 0.2 to 5 $g/m^2$.

(2) Spectral Sensitization

The photosensitive silver halide emulsion is preferably sensitized to a light in a desired wavelength range, thus, subjected to a so-called spectral sensitization. A color photographic light-sensitive material generally comprises photosensitive layers each having photosensitivity to blue, green or red, to provide an image faithful to the original. The photosensitivity may be obtained by spectrally sensitizing the silver halide with a so-called spectral sensitizing dye.

Examples of the spectral sensitizing dye include cyanine dyes, merocyanine dyes, composite cyanine dyes, composite merocyanine dyes, holopolar dyes, hemicyanine dyes, styryl dyes, hemioxonol dyes, etc. These examples are disclosed in U.S. Pat. No. 4,617,257, Japanese Patent Laid-Open Nos. 59-180550, 64-13546, 5-45828 and 5-45834, etc.

The spectral sensitizing dye may be singly used, and a plurality of the spectral sensitizing dyes may be used in combination with each other to control the wavelength distribution of the spectral sensitivity and to super-sensitize the photosensitive silver halide. In the case of using a combination of dyes having a super-sensitizing ability, the photosensitive silver halide exhibits sensitivity much larger than the sum of sensitivities attained by each dye.

Further, the spectral sensitizing dye is preferably used together with a super-sensitizer, which has the super-sensitizing ability and may be a dye having no spectral sensitizing ability or a compound that does not substantially absorb visible light. Such a super-sensitizer may be a diaminostilbene compound, etc., being disclosed in U.S. Pat. No. 3,615.641 and Japanese Patent Laid-Open No. 63-23145.

The spectral sensitizing dye and the super-sensitizer may be added to the silver halide emulsion at any time during the preparation of the emulsion. Although they may be added, for example, when a coating solution is prepared from the chemically sensitized emulsion, after the completion of the chemical sensitization, during the chemical sensitization, before the chemical sensitization, after the formation of the grains and before the desalting, during the formation of the grains, and/or before the formation of the grains, they are preferably added before the chemical sensitization to highly sensitize the silver halide.

The amount of the spectral sensitizing dye and the super-sensitizer may be selected depending on the shape of the silver halide grains, the size of the silver halide grains, or the desired photographic properties. Mole ratio of each of the spectral sensitizing dye and the super-sensitizer to 1 mol of the silver halide is generally $10^{-8}$ to $10^{-1}$ mol, preferably $10^{-5}$ to $10^{-2}$ mol. The spectral sensitizing dye and the super-sensitizer may be added to the silver halide as a solution using an organic solvent such as methanol, a fluoralcohlol, etc., or as an aqueous dispersion comprising a surfactant, a gelatin, etc.

(3) Dye-Providing Compound

The dye-providing compound used in the present invention is preferably a colorless or pale-colored compound that is colored after development. Specifically, the dye-providing compound may be a leuco dye or a coupling system comprising a color-developing agent and a coupler, and is preferably the coupling system.

Examples of the color-developing agent include p-phenylenediamine compounds, sulfonamidephenol compounds, carbamoylhydrazine compounds, etc. Precursors of the compounds are also preferably used. Specifically, preferably used as the precursors are the compounds represented by the following formula:

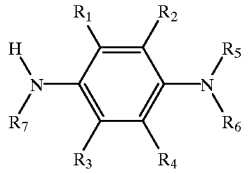

wherein $R_1$, $R_2$, $R_3$ and $R_4$ independently represent a hydrogen atom or a substituent; $R_5$ and $R_6$ independently represent an alkyl group, an aryl group, a heterocyclic group, an acyl group or a sulfonyl group; $R_1$ and $R_2$, $R_3$ and $R_4$, $R_5$ and $R_6$, $R_2$ and $R_5$, and/or $R_4$ and $R_6$ may be bonded together to form a 5-, 6- or 7-membered ring; and $R_7$ represents $R_{11}$—O—CO—, $R_{12}$—CO—CO—, $R_{13}$—NH—CO—, $R_{14}$—$SO_2$— or $(M)_{1/n}OSO_2$—, $R_{11}$, $R_{12}$, $R_{13}$ and $R_{14}$ independently being an alkyl group, an aryl group or a heterocyclic group and M being an n-valent cation.

The coupler may be such that known in the field of photographic art, and two equivalent or four equivalent. Examples of the coupler known in the field of photographic art are disclosed in Nobuo Furutachi, "Organic compounds for a conventional color photography", Journal of Synthetic Organic Chemistry, Japan, Vol. 41, Page 439, 1983, Research Disclosure No. 37038, February 1995, Page 80 to 85 and 87 to 89, etc.

Examples of the yellow image-forming coupler include: pivaloylacetamide couplers; benzoylacetamide couplers; malonic diester couplers; malonic diamide couplers; dibenzoylmethane couplers; malonic ester monoamide couplers; benzoxazolylacetamide couplers; benzimidazolylacetamido couplers; benzthiazolylacetamide couplers; cycloalkylcarbonylacetamide couplers; indoline-2-yl-acetamide couplers; quinazoline-4-one-2-yl-acetamide couplers described in U.S. Pat. No. 5,021,332; benzo-1,2,4-thiadiazine-1,1-dioxide-3-yl-acetamide couplers described in U.S. Pat. No. 5,021,330; couplers described in European Patent No. 421221A; couplers described in U.S. Pat. No. 5,455,149; couplers described in European Patent No. 622673; 3-indoloylacetamide couplers described in European Patent Nos. 953872A and 953873A; etc.

Examples of the magenta image-forming coupler include: 5-pyrazolone couplers; 1H-pyrazolo[1,5-a]benzimidazole couplers; 1H-pyrazolo[5,1-c][1,2,4]triazole couplers; 1H-pyrazolo[1,5-b][1,2,4]triazole couplers; 1H-imidazo[1,2-b]pyrazole couplers; cyanoacetophenone couplers; active propene couplers described in WO 93/01523; enamine couplers described in WO 93/07534; 1H-imidazo[1,2-b][1,2,4]triazole couplers; couplers described in U.S. Pat. No. 4,871,652; etc.

Examples of the cyan image-forming coupler include: phenol couplers; naphthol couplers; 2,5-diphenylimidazole couplers described in European Patent No. 249453; 1H-pyrrolo[1,2-b][1,2,4]triazole couplers; 1H- pyrrolo[2,1-c][1,2,4]triazole couplers; pyrrole couplers described in Japanese Patent Laid-Open Nos. 4-188137 and 4-190347; 3-hydroxypyridine couplers described in Japanese Patent Laid-Open No. 1-315736; pyrrolopyrazole couplers described in U.S. Pat. No. 5,164,289; pyrroloimidazole couplers described in Japanese Patent Laid-Open No. 4-174429; pyrazolopyrimidine couplers described in U.S. Pat. No. 4,950,585; pyrrolotriazine couplers described in Japanese Patent Laid-Open No. 4-204730; couplers described in U.S. Pat. No. 4,746,602; couplers described in U.S. Pat. No. 5,104,783; couplers described in U.S. Pat. No. 5,162,196; couplers described in European Patent No. 556700; etc.

Specific examples of the coupler used in the present invention will be shown below without intention of restricting the scope of the present invention.

CP-101

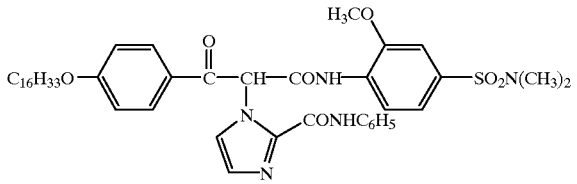

CP-102

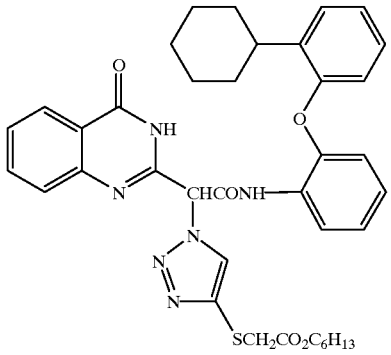

-continued
CP-103
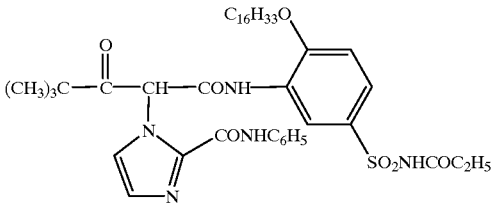
CP-104
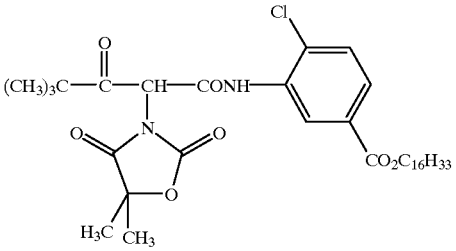
CP-105
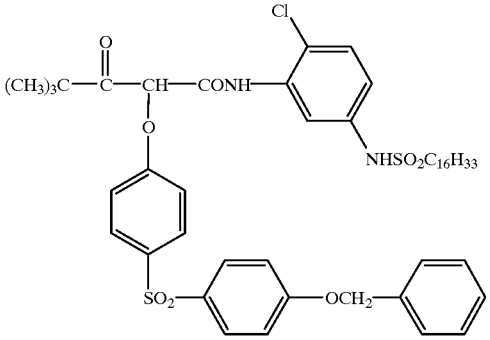
CP-106
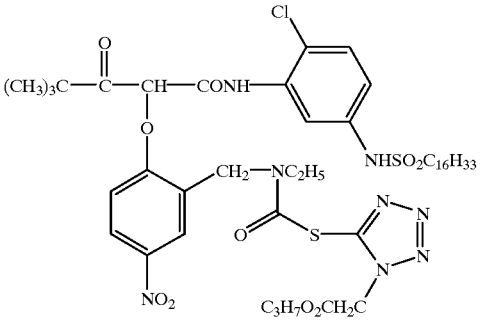
CP-107
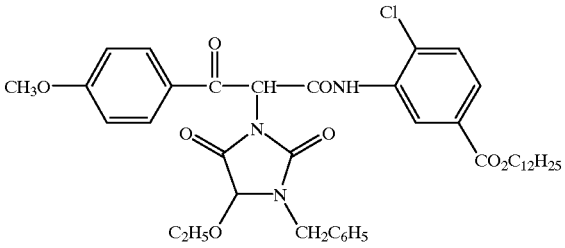
CP-108
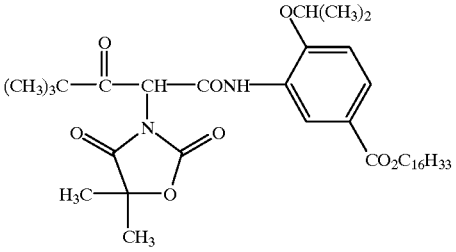
CP-109
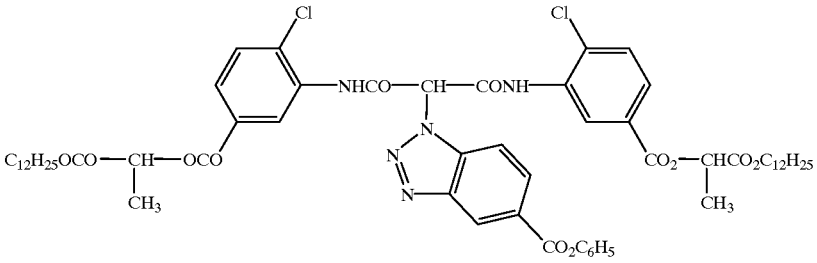
CP-110
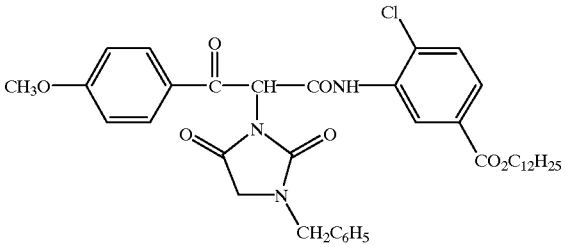
CP-111
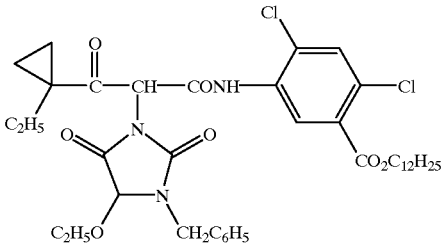

-continued
CP-112
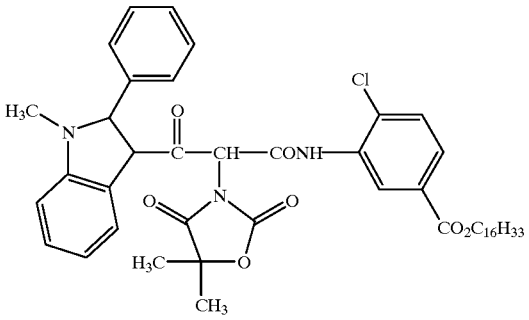
CP-113
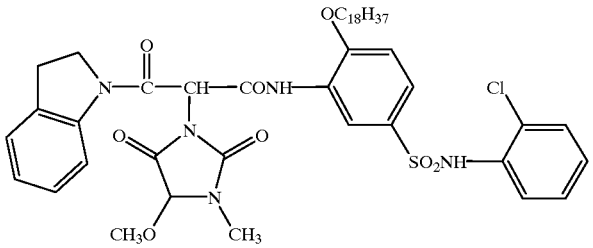
CP-114
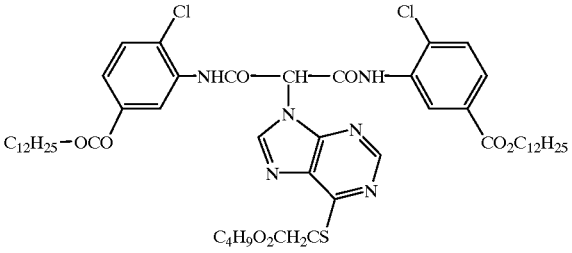
CP-201
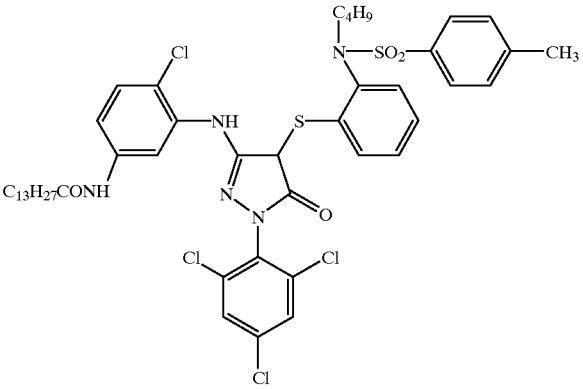
CP-202
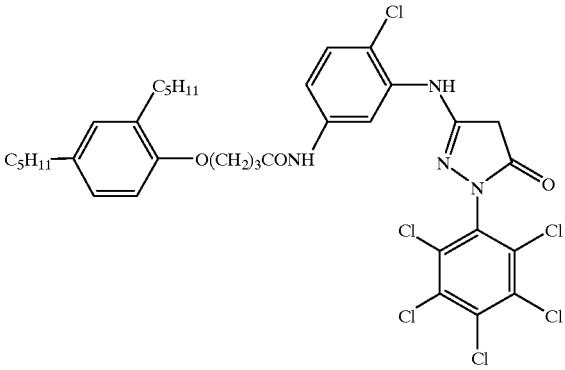
CP-203
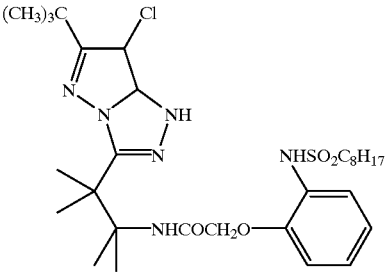
CP-204
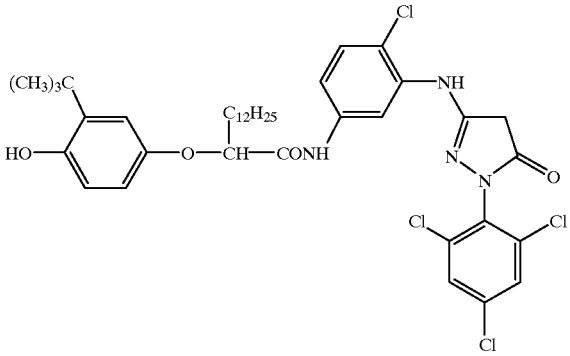
CP-205
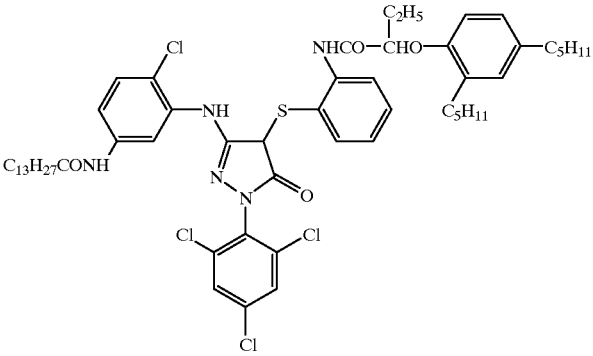

-continued
CP-206
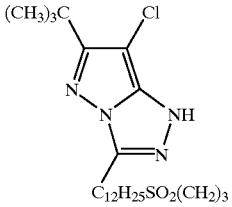
CP-207
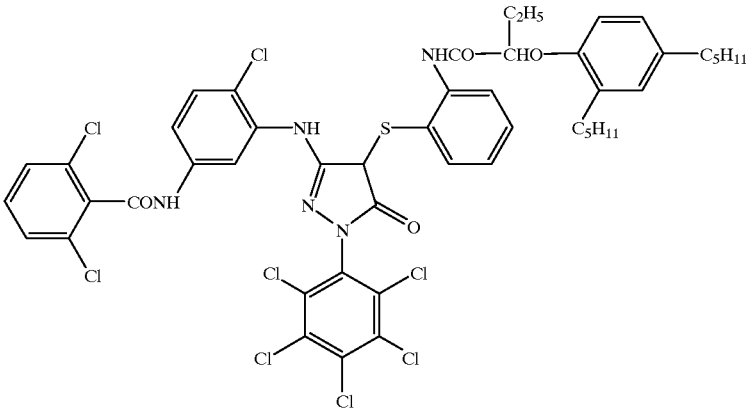
CP-208
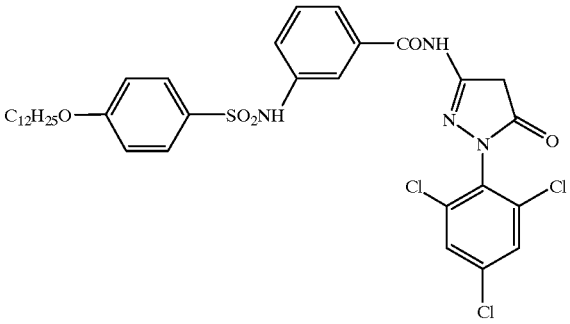
CP-209
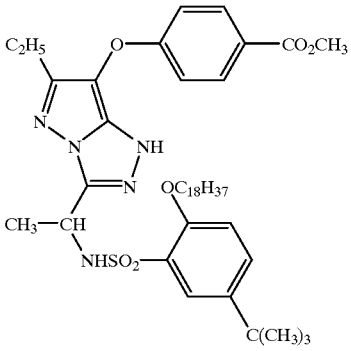
CP-210
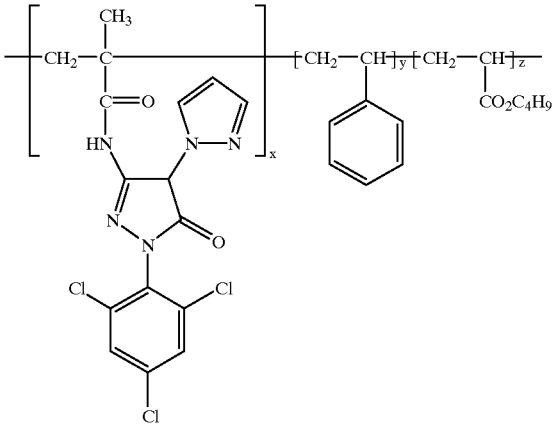
x/y/z = 50/25/25 (weight ratio)
CP-211
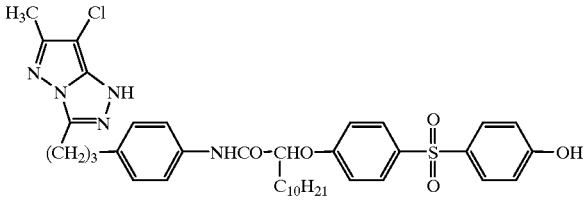

-continued
CP-212
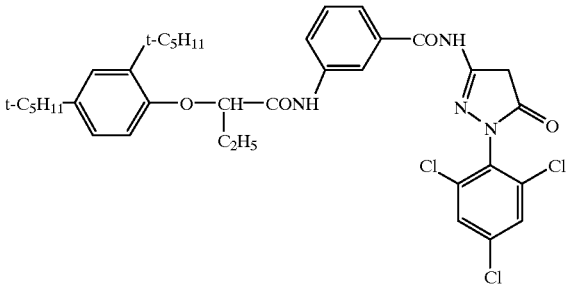
CP-213
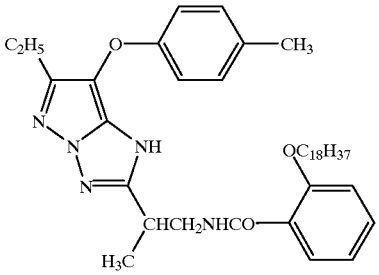
CP-214
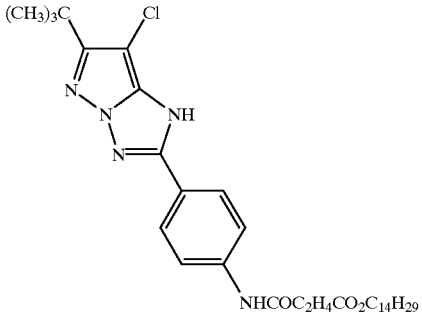
CP-215
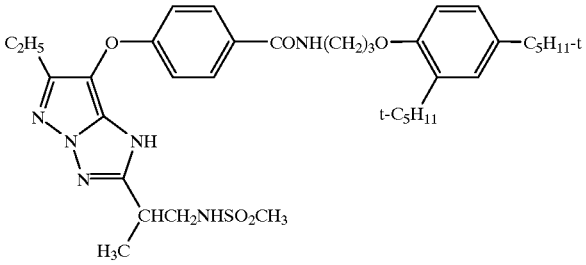
CP-216
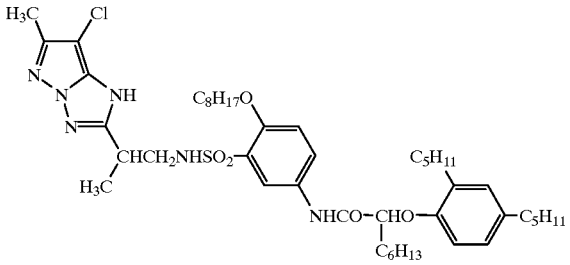
CP-217
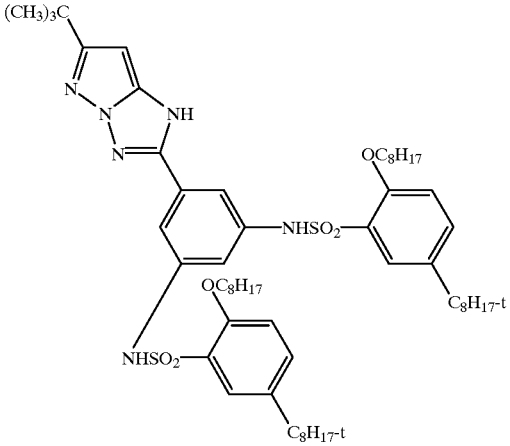
CP-218
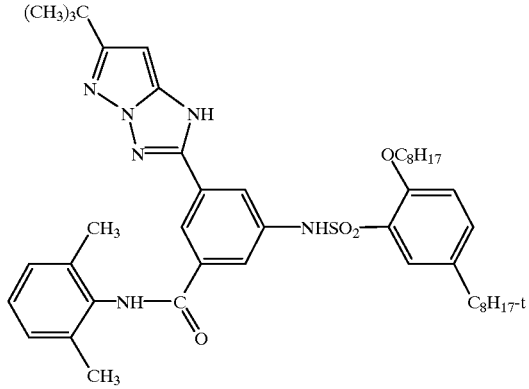
CP-301
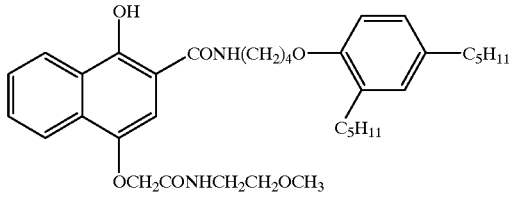

-continued
CP-302
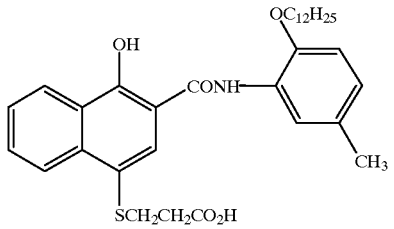
CP-303
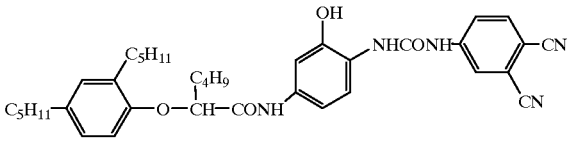
CP-304
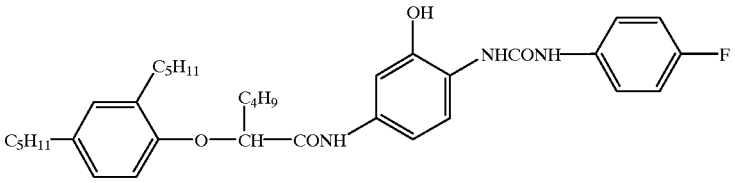
CP-305
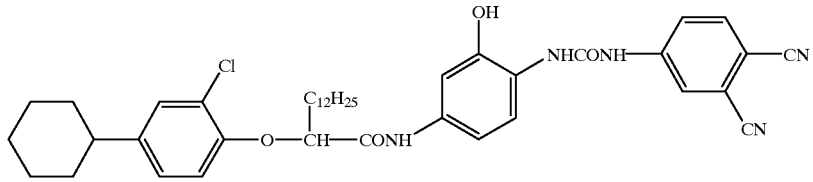
CP-306
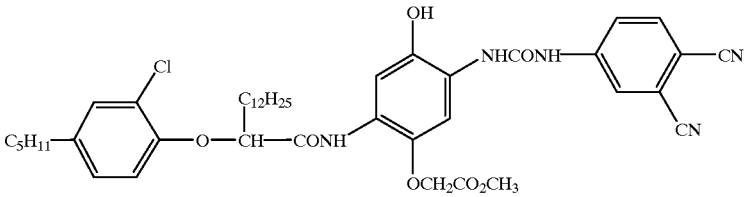
CP-307
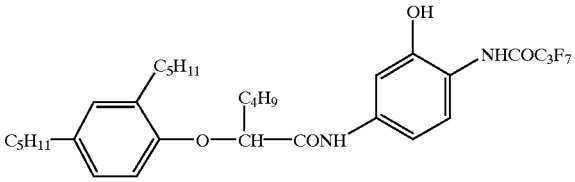
CP-308
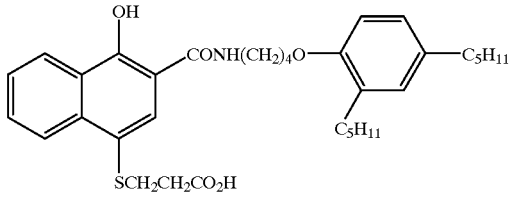
CP-309
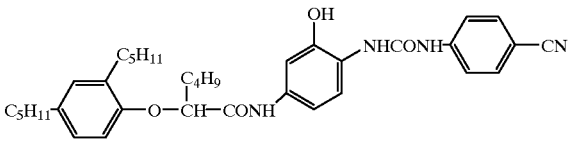
CP-310
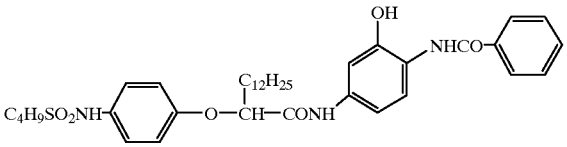
CP-311
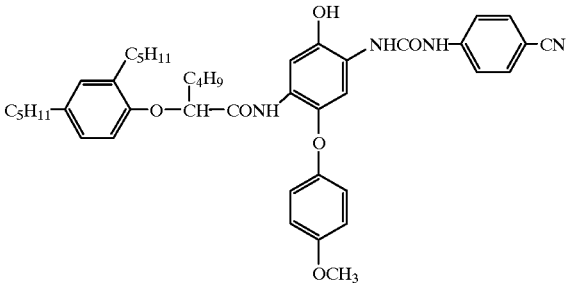
CP-312
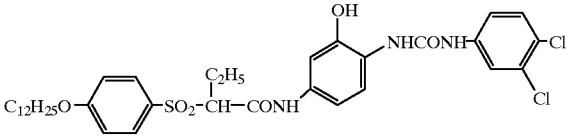

-continued
CP-313
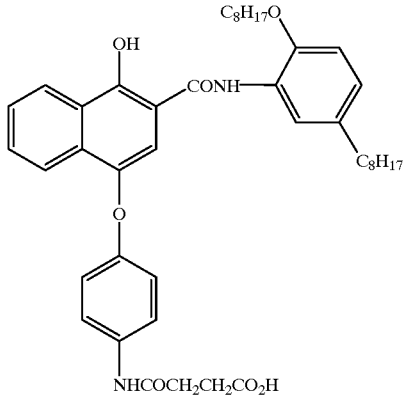
CP-314
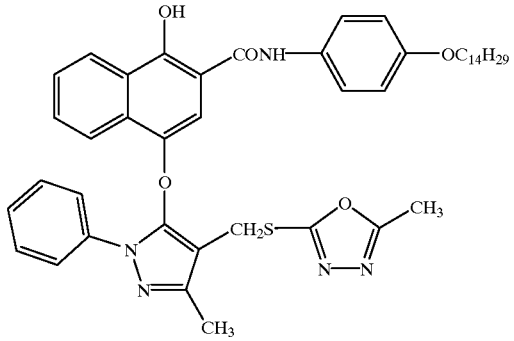
CP-315
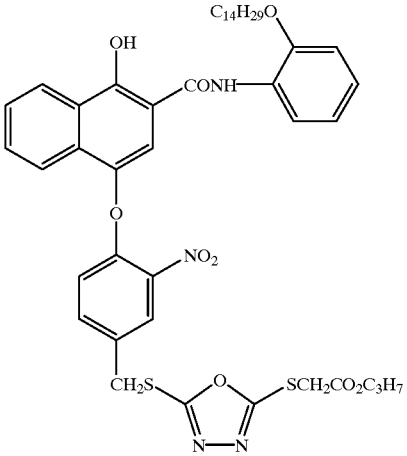
CP-316
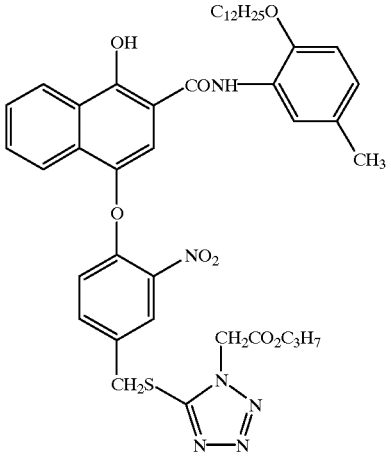
CP-317
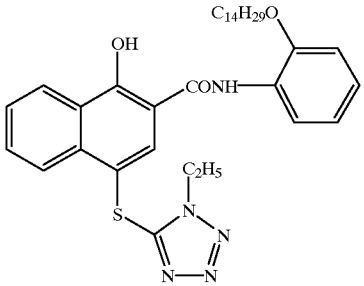
CP-318
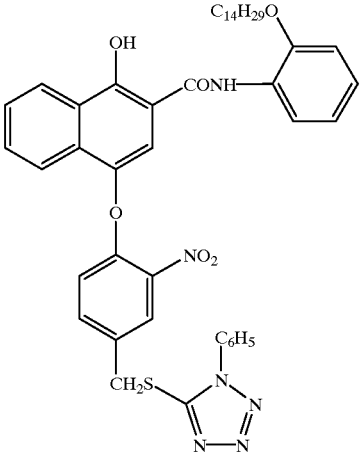
CP-319
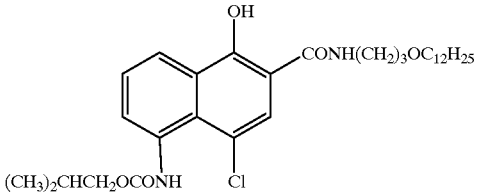
CP-320
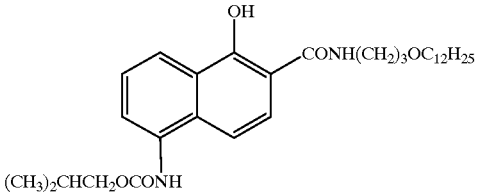

-continued
CP-321
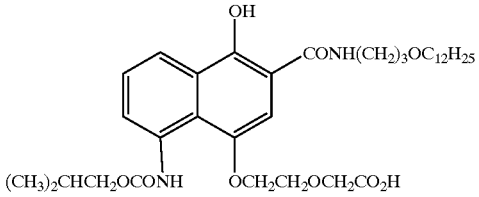
CP-322
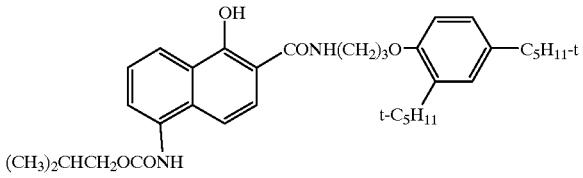
CP-323
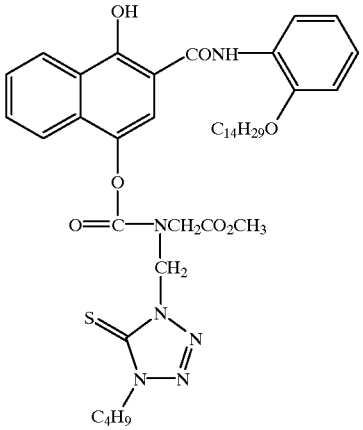
CP-324
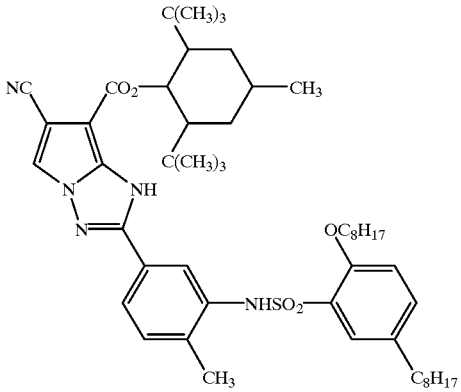
CP-325
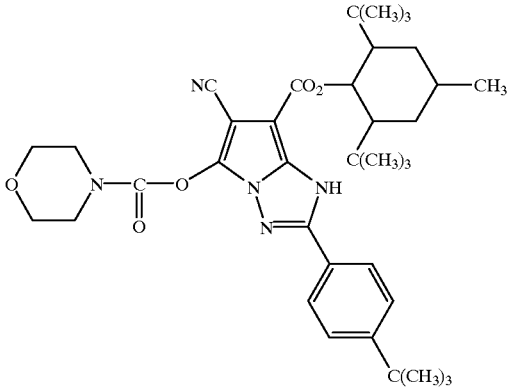
CP-326
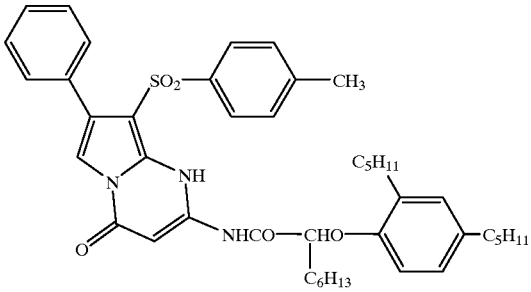
CP-327
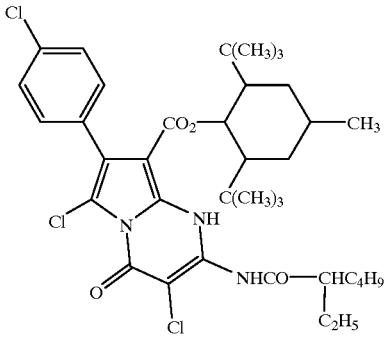
CP-328
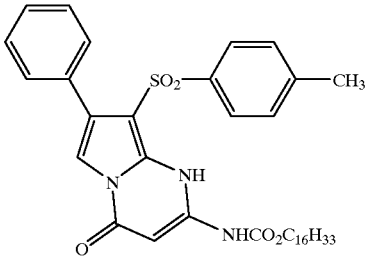

-continued

CP-329

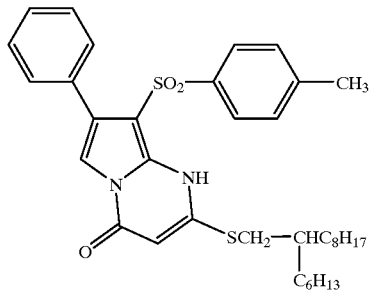

CP-330

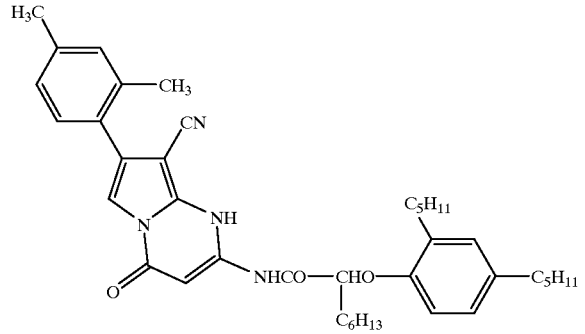

The coupler used in the present invention can be easily synthesized by a conventional method known in the art, as described in the above references.

The coupler may be dissolved to use in water or an organic solvent. Examples of the organic solvent include: alcohols such as methanol, ethanol, propanol and fluorinated alcohol; ketones such as acetone and methylethyl ketone; dimethylformamide; dimethylsulfoxide; methyl cellosolve; etc.

Hydrophobic additives such as the coupler, the color-developing agent, etc. may be introduced into the photosensitive material by a known method as described in U.S. Pat. No. 2,322,027, etc. When the hydrophobic additives are introduced into the photosensitive material, a low boiling organic solvent having a boiling point of 50 to 160° C. may be used in combination with a high boiling organic solvent disclosed in U.S. Pat. Nos. 4,555,470, 4,536,466, 4,536,467, 4,587,206, 4,555,476 and 4,599,296, Japanese Patent Publication No. 3-62256, etc., if necessary. A plurality of the couplers, the high boiling organic solvents, etc. may be used in combination therewith.

Amount of the high boiling organic solvent is generally 10 g or less, preferably 5 g or less, more preferably 1 to 0.1 g, to 1 g of the hydrophobic additives. Further, amount of the high boiling organic solvent to 1 g of the binder is preferably 1 ml or less, more preferably 0.5 ml or less, particularly preferably 0.3 ml or less.

The hydrophobic additives may be added to the photosensitive material by: a dispersion method using a polymer described in Japanese Patent Publication No. 51-39853 and Japanese Patent Laid-Open No. 51-59943; or a method where the hydrophobic additives are formed into a dispersion of fine particles to be added described in Japanese Patent Laid-Open No. 62-30242, etc. The hydrophobic additives substantially insoluble in water may be added and dispersed to the binder as fine particles.

Various surfactants may be used when the hydrophobic additives are dispersed in a hydrophilic colloid. The surfactants disclosed in Japanese Patent Laid-Open No. 59-157636, Page 37 to 38, Research Disclosure mentioned below, etc. may be used in the present invention. Further, phosphate surfactants described in Japanese Patent Application Nos. 5-204325 and 6-19247, and West German Patent Publication No. 1,932,299A may also be used in this invention.

The coupler may be dispersed in water as fine particles by a known solid dispersion method using a ball mill, a colloid mill, a sand grinder mill, a mantongaulin, a microfluidizer or ultrasonic wave.

Although the coupler may be added to any layer disposed on the photosensitive layer side of the substrate, the coupler is preferably added to the layer comprising the silver halide or that adjacent thereto. Amount of the coupler is preferably 0.2 to 1,000 mmol, more preferably 0.3 to 500 mmol, particularly preferably 1 to 200 mmol, per 1 mol of silver comprised in the silver halide. A plurality of the coupler may be used in combination therewith.

In the present invention, the following functional couplers (a) to (c) may be used: (a) couplers that provide a dye having an appropriate diffusion properties described in U.S. Pat. No. 4,366,237, GB2,125,570, EP96,873B, DE 3,234,533, etc; (b) couplers that act to compensate a useless absorption of the dye, such as yellow-colored cyan couplers and yellow-colored magenta couplers described in EP456, 257A1, magenta-colored cyan couplers described in U.S. Pat. No. 4,833,069, colorless masking couplers represented by (2) of U.S. Pat. No. 4,837,136 or formula (A) of WO 92/11575, particularly, exemplified compounds in Page 36 to 45, etc.; and (c) compounds including couplers that react with an oxidized developing agent to release a photographically useful residue.

Examples of the compounds of (c) include: (i) development inhibitor-releasing compounds such as compounds represented by formulae (I) to (IV) described in EP378, 236A1, Page 11, compounds represented by formula (I) described in EP436,938A2, Page 7, compounds represented by formula (I) described in EP568,037A, compounds represented by formulae (I), (II) and (III) described in EP440, 195A2, Page 5 to 6, etc; (ii) bleach accelerator-releasing compounds such as compounds represented by formulae (I) and (I') described in EP310,125A2, Page 5, compounds represented by formula (I) described in Japanese Patent Laid-Open No. 6-59411, etc.; (iii) ligand-releasing compounds such as compounds represented by LIG-X described in U.S. Pat. No. 4,555,478; (iv) leuco dye-releasing compounds such as compounds 1 to 6 described in Column 3 to 8 of U.S. Pat. No. 4,749,641, fluorescent dye-releasing compounds, compounds represented by COUP-DYE described in U.S. Pat. No. 4,774,181, etc.; (v) development accelerator- or fogging agent-releasing compounds such as compounds represented by formulae (1), (2) and (3) in Column 3 of U.S. Pat. No. 4,656,123, ExZK-2 described in EP450,637A2, Page 75, Line 36 to 38, etc.; and (vi) compounds that acts as a dye after releasing a group such as compounds represented by formula (I) of U.S. Pat. No. 4,857,447, compounds represented by formula (1) of Japanese Patent Application No. 4-134523, compounds represented by formulae (I), (II) and (III) described in EP440, 195A2, Page 5 and 6, compounds including ligand-releasing compounds represented by formula (I) of Japanese Patent Application No. 4-325564, compounds represented by LIG-X of U.S. Pat. No. 4,555,478, etc.

Amount of the functional coupler is generally 0.05 to 10 mol, preferably 0.1 to 5 mol, per 1 mol of the above-mentioned coupler that acts to color.

The dye-providing coupler and the color-developing agent may be comprised in the photosensitive layer, and may be separately comprised in different layers if they can react with each other. For example, the color-developing agent may be comprised in a layer other than the photosensitive layer comprising the coupler to increase storage stability of the unexposed photosensitive material.

The relationship between the spectral sensitivity of each layer and hue provided by the coupler is not limited to the particular one. In the case where a cyan coupler, a magenta coupler and a yellow coupler are used in a red-sensitive layer, a green-sensitive layer and a blue-sensitive layer, respectively, the photosensitive material can be printed directly on a color paper, etc.

(4) Binder

The binder may be selected from well-known natural or artificial resins such as gelatin, poly(vinyl acetal), poly(vinyl chloride), poly(vinyl acetate), cellulose acetate, polyolefins, polyesters, polystyrene, polyacrylonitrile, polycarbonate, etc. The binder may be a copolymer or a terpolymer. These polymers may be used in combination therewith. Amount of the binder is selected such that it can sufficiently hold ingredients therein, thus, such that it can efficiently act as a binder.

(5) Other Additives

The photosensitive silver halide and/or the silver salt that can be reduced may be protected from a formation of additional fogging by an antifoggant, a stabilizer, or a precursor thereof, whereby the photosensitive material is stabilized against reduction in sensitivity during storage. Examples of the antifoggant, the stabilizer and the precursor thereof include: thiazonium salts described in U.S. Pat. Nos. 2,131,038 and 2,694,716; azaindene compounds described in U.S. Pat. Nos. 2,886,437 and 2,444,605; mercury salts described in U.S. Pat. No. 2,728,663; urazol compounds described in U.S. Pat. No. 3,287,135; sulfocatechol compounds described in U.S. Pat. No. 3,235,652; oxime compounds, nitron compounds and nitroindazole compounds described in British Patent No. 623,448; polyvalent metal salts described in U.S. Pat. No. 2,839,405; thiuronium salts described in U.S. Pat. No. 3,220,839; palladium salts, platinum salts and gold salts described in U.S. Pat. Nos. 2,566,263 and 2,597,915; halogenated organic compounds described in U.S. Pat. Nos. 4,108,665 and 4,442,202; triazine compounds described in U.S. Pat. Nos. 4,128,557, 4,137,079, 4,138,365 and 4,459,350; phosphorous compounds described in U.S. Pat. No. 4,411,985; combinations thereof; etc.

Preferably used as the antifoggant in the present invention are organohalogen compounds described in Japanese Patent Laid-Open Nos. 50-119624, 50-120328, 51-121332, 54-58022, 56-70543, 56-99335, 59-90842, 61-129642, 62-129845, 6-208191, 7-5621, 7-2781 and 8-15809, U.S. Pat. Nos. 5,340,712, 5,369,000 and 5,464,737, etc.

The antifoggant, the stabilizer and the precursor thereof may be added to the silver halide emulsion at any time during the preparation of the emulsion. They may be added, for example, when a coating solution is prepared from the chemically sensitized emulsion, after the completion of the chemical sensitization, during the chemical sensitization, before the chemical sensitization, after the formation of the grains and before the desalting, during the formation of the grains, and/or before the formation of the grains.

Amount of the antifoggant, the stabilizer and the precursor thereof may be selected depending on the halogen composition of the silver halide emulsion and the end of the photosensitive material. The amount is generally $10^{-6}$ to $10^{-1}$ mol, preferably $10^{-5}$ to $10^{-2}$ mol, per 1 mol of the silver halide.

To the photosensitive layer may be added a hardening agent such as a polyisocyanate compound described in U.S. Pat. No. 4,281,060, Japanese Patent Laid-Open No. 6-208193, etc., an epoxy compounds described in U.S. Pat. No. 4,791,042, etc., and a vinylsulfone compounds described in Japanese Patent Laid-Open No. 62-89048, etc.

Further, a surfactant may be used to improve a coating property, electrification, etc. The surfactant used in the present invention is not particularly limited, may be a nonionic surfactant, an anionic surfactant, a cationic surfactant, a fluorine-based surfactant, etc. Specific examples of the surfactants include: fluorine-comprising high molecular surfactants described in Japanese Patent Laid-Open No. 62-170950 and U.S. Pat. No. 5,380,644; fluorine-based surfactants described in Japanese Patent Laid-Open Nos. 60-244945 and 63-188135; polysiloxane-based surfactants described in U.S. Pat. No. 3,885,965; poly(alkylene oxide) surfactants and anionic surfactants described in Japanese Patent Laid-Open No. 6-301140; etc.

Such additives that mentioned above known in photographic field are also described in Research Disclosure (hereinafter referred to as RD), Nos. 17643 (December 1978), 18716 (November 1979) and 307105 (November 1989):

| Additives | RD 17643 | RD 18716 | RD 307105 |
|---|---|---|---|
| Chemical Sensitizer | Page 23 | Page 648, Right Column | Page 866 |
| Sensitivity-Increasing Agent | — | Page 648, Right Column | — |
| Spectral Sensitizer | Page 23 to 24 | Page 648, Right Column | Page 866 to 868 |
| Super-Sensitizer | Page 23 to 24 | Page 649, Right Column | Page 866 |
| Brightening Agent | Page 24 | Page 648, Right Column | Page 868 |
| Antifoggant | Page 24 to 26 | Page 649, Right Column | Page 868 to 870 |
| Light Absorbent | Page 25 to 26 | Page 649, Right Column | Page 873 |
| Filter Dye | — | Page 650, Left Column | — |
| Dye Image Stabilizer | Page 25 | Page 650, Left Column | Page 872 |
| Hardening Agent | Page 26 | Page 651, Left Column | Page 874 to 875 |
| Binder | Page 26 | Page 651, Left Column | Page 873 to 874 |
| Plasticizer or Lubricant | Page 27 | Page 650, Right Column | Page 876 |
| Coating Aid | Page 26 to 27 | Page 650, Right Column | Page 875 to 876 |
| Antistatic Agent | Page 27 | Page 650, Right Column | Page 876 to 877 |
| Matting Agent | — | — | Page 878 to 879 |

(C) Substrate

The substrate used for the photosensitive material of the present invention is not particularly limited. The substrate may be made of polyester, polyethyleneterephthalate, polyethylenenaphthalate, cellulose nitrate, cellulose ester, polyvinylacetal, polycarbonate, a derivative thereof, a glass, a paper, a metal, etc. The substrate may be an under-coated polyester film. The substrate is preferably made of a flexible material, particularly a paper coated with a baryta and/or a partially acetylated α-olefin polymer having 2 to 10 carbon atoms such as polyethylene, polypropylene and ethylene-butene copolymer.

The substrate is preferably transparent although it may be transparent or opaque. The transparent substrate is particularly preferably made of a biaxial-stretched, polyethyleneterephthalate (PET) having a thickness of 75 to 200 μm.

When a plastic film is passed through a thermal developing processor at 80° C. or higher, the plastic film is generally shrunken. Thus, it is preferable that the plastic film having an excellent dimensional stability is used as the substrate, where an internal strain of the plastic film is relaxed at the biaxial stretching process to prevent the plastic film from shrinking at the thermal developing process. For example, a polyethyleneterephthalate film that is heat-treated at 100 to 210° C. before a photographic emulsion is applied thereon is preferably used. Materials having a high glass-transition temperature are also preferably used for the substrate, and examples thereof include polyetherethylketone, polystyrene, polysulfone, polyethersulfone, polyarylate, polycarbonate, etc.

(D) Layered Structure of Photosensitive Material

The photosensitive material of the present invention generally comprises at least one photosensitive layer disposed on the substrate.

For example, the silver halide photosensitive material for photographing typically has a structure where at least one photosensitive unit composed of a laminate of a plurality of silver halide emulsion layers having substantially the same color sensitivity and different photosensitivity is disposed on the substrate. The photosensitive unit generally has a color sensitivity to any of blue light, green light and red light. In the multi-layered silver halide color photosensitive material for photographing, a red-sensitive layer, a green-sensitive layer and a blue-sensitive layer are generally disposed in this order from the substrate side, however, the layers may be disposed in the reverse thereof. Further, another color-sensitive layer may be disposed between a plurality of the same color-sensitive layers.

The photosensitive unit is preferably composed of a low-photosensitive silver halide emulsion layer and a high-photosensitive silver halide emulsion layer, which are disposed in this order from the substrate side, as described in DE1,121,470 or GB923,045. Further, the high-photosensitive emulsion layer and the low-photosensitive emulsion layer may be disposed in this order from the substrate side, as described in Japanese Patent Laid-Open Nos. 57-112751, 62-200350, 62-206541 and 62-206543.

Specifically, a low-photosensitive, blue-sensitive layer (BL), a high-photosensitive, blue-sensitive layer (BH), a high-photosensitive, green-sensitive layer (GH), a low-photosensitive, green-sensitive layer (GL), a high-photosensitive, red-sensitive layer (RH) and a low-photosensitive, red-sensitive layer (RL) may be disposed from the substrate side in such order as RL/RH/GL/GH/BH/BL; RL/RH/GH/GL/BL/BH; RH/RL/GL/GH/BL/BH; etc. Further, these layers may be disposed from the substrate side in order of RL/GL/RH/GH/BH or BL as described in Japanese Patent Publication No. 55-34932, or in order of RH/GH/RL/GL/BH or BL as described in Japanese Patent Laid-Open Nos. 56-25738 and 62-63936.

A low-photosensitive silver halide emulsion layer, a middle-photosensitive silver halide emulsion layer and a high-photosensitive silver halide emulsion layer may be disposed in this order from the substrate side, such that the sensitivities of the silver halide emulsion layers are reduced toward the substrate, as described in Japanese Patent Publication No. 49-15495. Further, as described in Japanese Patent Laid-Open No. 59-202464, the low-photosensitive layer, the high-photosensitive layer and the middle-photosensitive layer may be disposed in this order from the substrate side. Also, these layers may be disposed in order of the middle-photosensitive layer/the low-photosensitive layer/the high-photosensitive layer; the high-photosensitive layer/the middle-photosensitive layer/the low-photosensitive layer; etc. Four or more photosensitive layers having different sensitivity may be disposed in the photosensitive material in such order as above.

To improve in color-reproducibility of the photosensitive material, a donor layer (CL), which has a spectral sensitivity distribution different from the main photosensitive layers such as BL, GL and RL and which provides an interlayer effect, is preferably disposed adjacent to or in close vicinity to the photosensitive layers, as described in U.S. Pat. Nos. 4,663,271, 4,705,744 and 4,707,436, and Japanese Patent Laid-Open Nos. 62-160448 and 63-89850.

The relationship between the spectral sensitivity of each layer and hue provided by the coupler is not limited to the particular one. In the case where a cyan coupler, a magenta coupler and a yellow coupler are used in a red-sensitive layer, a green-sensitive layer and a blue-sensitive layer, respectively, the photosensitive material can be printed directly on a color paper, etc.

The photosensitive material of the present invention may comprise photo-insensitive layers such as a protective layer, an undercoat layer, an intermediate layer, a yellow filter layer, an antihalation layer, etc. Auxiliary layers such as a back layer may be disposed on the back surface of the substrate. Specifically, the photosensitive material of the present invention may comprise: an undercoat layer (or subbing layer) described in U.S. Pat. No. 5,051,335; an intermediate layer comprising a solid pigment described in Japanese Patent Laid-Open Nos. 1-167838 and 61-20943; an intermediate layer comprising a reducing agent or a development-inhibitor-releasing compound (DIR compound) described in Japanese Patent Laid-Open Nos. 1-120553, 5-34884 and 2-64634; an intermediate layer comprising an electron-transporting agent described in U.S. Pat. Nos. 5,017,454 and 5,139,919, and Japanese Patent Laid-Open No. 2-235044; a protective layer comprising a reducing agent described in Japanese Patent Laid-Open No. 4-249245; a combination thereof; etc.

[II] Image-Forming Method Using Photosensitive Material of Present Invention

A method for forming an image of the present invention comprises the steps of: exposing the photosensitive material of the present invention; developing the exposed photosensitive material to provide an image information thereon; and reading the image information by a scanner at a temperature equal to or higher than the above-mentioned decoloration initiation temperature to produce an image data.

The silver halide photosensitive material for photographing of the present invention may be subjected to exposure by a known method. Thus, various light sources including infrared sources such as natural light (sun light), a tungsten lamp, a fluorescent lamp, a mercury lamp, a xenon arc lamp, a carbon arc lamp, a xenon flush lamp, a cathode ray tube flying spot, a light-emitting diode, a laser light such as gas laser, YAG laser, dye laser and semiconductor laser, etc. may be used for exposing the photosensitive material. The photosensitive material may be exposed by a light provided from a fluorescent substance excited by electron ray, X-ray, γ-ray, α-ray, etc. The exposing period may be 1/1000 to 1 second of ordinary camera, shorter than 1/1000 second in the case where a xenon flash lamp, a cathode ray tube, etc. are used as the light source, and longer than 1 second. A spectral composition of the light source may be controlled by a color filter, if necessary.

A method for developing the silver halide photosensitive material for photographing of the present invention is not limited in particular. For example, any known methods described in Research Disclosure, Vol. 176, Page 28 to 30, may be properly used in this invention. The developing process may be selected form a photographic process for forming a silver image (black and white photographic processing), and a photographic process for forming a color image (color photographic processing). The developing (processing) temperature is preferably 18 to 50° C. although it is not particularly limited. Particularly, to restrain both fogging and fluctuation of photographic properties, the developing process is preferably carried out rapidly at a high temperature, the developing temperature being preferably 30 to 50° C., and the developing period being preferably 20 to 150 seconds for the black and white photographic processing and preferably 120 to 240 seconds for the color photographic processing.

In the case of using the photosensitive material of the present invention as a heat-developable photosensitive material, the photosensitive material is generally developed by heating the image-wise-exposed photosensitive material although a method for developing the material is not limited in particular. A thermal developing processor may be used in this developing process, and examples of preferred thermal developing processor include: thermal developing processors where the heat-developable photosensitive material is made to come into contact with a heat sources such as a heat roller and a heat drum, described in Japanese Patent Publication No. 5-56499, Japanese Patent No. 684453, Japanese Patent Laid-Open Nos. 9-292695 and 9-297385, and WO 95/30934; non-contact type thermal developing processors described in Japanese Patent Laid-Open No. 7-13294, WO 97/28489, WO 97/28488 and WO 97/28487; etc. Among them, particularly preferred are the non-contact type thermal developing processors. The developing temperature is preferably 80 to 250° C., more preferably 100 to 140° C. The developing period is preferably 1 to 180 second, more preferably 10 to 90 seconds.

After developing the exposed photosensitive material, an image information provided on the photosensitive material is read by a scanner at a temperature equal to or higher than the decoloration initiation temperature, to produce an image data. In the case where the photosensitive material is thermal-developed, the reversibly decolorable colored layer of the photosensitive material is decolored at the thermal-developing process. Thus, it is preferable that the image information provided on the photosensitive material is read by a scanner after the thermal-developing process while keeping the material at such a temperature that the decolored, reversibly decolorable colored layer is substantially not colored again, to produce a regenerative, digital image data.

EXAMPLES

The present invention will be specifically described below with reference to Examples without intention of restricting the scope of the present invention.

Example 1

26 g of the leuco dye (67), 25 g of the following developer PH-1, 45 g of decoloring compound (stearyl alcohol) and 50 g of ethyl acetate were mixed and heated to 60° C. to prepare a homogeneous solution. The homogeneous solution was added to a liquid composed of 7 g of lime-treated gelatin, 0.4 g of sodium dodecylbenzene sulfonate and 100 g of water, and emulsified and dispersed by means of a homogenizer, to prepare a reversibly decolorable colored dispersion for an antihalation layer.

PH-1

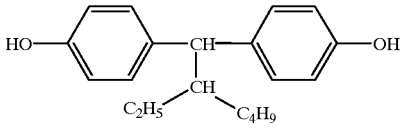

20 g of thus-obtained reversibly decolorable colored dispersion, 11 g of a 14% lime-treated gelatin aqueous solution and 19 g of water were mixed, applied on a polyethyleneterephthalate film having a gelatin undercoat layer at applying amount of 35 ml/$m^2$, and dried to prepare a reversibly decolorable colored film. The color density of the reversibly decolorable colored film was rapidly reduced to ⅓ when the reversibly decolorable colored film was heated to 60° C., and the color density was further reduced by heating to higher temperature so that the reversibly decolorable colored film was completely decolored at 110° C. When the resultant, decolored, reversibly decolorable colored film was cooled down to room temperature, the color density thereof was gradually increased and reached to the initial color density 2 minutes later. The reversibly decolorable colored film could be reversibly colored and decolored while repeating this temperature-change five times.

Example 2

(a) Preparation of Reversibly Decolorable Colored Dispersion for Yellow Filter Layer 22 g of the leuco dye (7), 25 g of the developer PH-1, 45 g of decoloring compound (stearyl alcohol) and 50 g of ethyl acetate were mixed and heated to 60° C. to prepare a homogeneous solution. The homogeneous solution was added to a liquid composed of 7 g of lime-treated gelatin, 0.4 g of sodium dodecylbenzene sulfonate and 100 g of water, and emulsified and dispersed by means of a homogenizer, to prepare a reversibly decolorable colored dispersion for a yellow filter layer.

(b) Preparation of Reversibly Decolorable Colored Dispersion for Magenta Filter Layer A reversibly decolorable colored dispersion for a magenta filter layer was prepared in the same manner as the reversibly decolorable colored dispersion for the yellow filter layer, except for using 26 g of the leuco dye (22) instead of 22 g of the leuco dye (7).

(c) Preparation of Silver Halide Emulsion (i) Preparation of Emulsion A-1

A mixture of 0.37 g of gelatin having an average molecular weight of 15000, 0.37 g of an acid-treated gelatin, 0.7 g of potassium bromide and 930 ml of distilled water was placed in a reaction vessel and heated to 38° C. To the resultant mixture was added 30 ml of an aqueous solution comprising 0.34 g of silver nitrate and 30 ml of an aqueous solution comprising 0.24 g of potassium brormide in 20 seconds while stirring. The mixture was maintained at 40° C. for 1 minute after adding, and heated to 75° C. To this was added 200 ml of distilled water and 27.0 g of gelatin having a trimellitic acid-modified armino group, and further added 100 ml of an aqueous solution comprising 23.36 g of silver nitrate and 80 ml of an aqueous solution comprising 16.37 g of potassium bromide over 36 minutes while increasing the adding flow rate.

Then, to the resultant mixture was added 250 ml of an aqueous solution comprising 83.2 g of silver nitrate, and an aqueous solution comprising potassium iodide and potassium bromide (in which mole ratio of potassium iodide/potassium bromide was 3/97 and concentration of potassium bromide was 26%) over 60 minutes while the adding flow rate was increased such that the mixture exhibited a silver potential of −50 mV with respect to a saturated calomel electrode. Further, to the resultant mixture was added 75 ml of an aqueous solution comprising 18.7 g of silver nitrate, and a 21.9% potassium bromide aqueous solution over 10 minutes while controlling a silver potential of the mixture to 0 mV with respect to a saturated calomel electrode. The mixture was maintained at 75° C. for 1 minute and cooled to 40° C. To this was added 100 ml of an aqueous solution comprising 10.5 g of sodium p-iodoacetamidobenzene sulfonate monohydrate to adjust the pH value of the mixture to 9.0.

Next, the resultant mixture was added to 50 ml of an aqueous solution comprising 4.3 g of sodium sulfite, maintained at 40° C. for 3 minutes, and heated to 55° C. After adjusting pH value of the mixture to 5.8, to the mixture was added 0.8 mg of sodium benzenethiosulfinate, 0.04 mg of potassium hexachloro iridate (IV) and 5.5 g of potassium bromide. The mixture was maintained at 55° C. for 1 minute, and then, to this was added 180 ml of an aqueous solution comprising 44.3 g of silver nitrate and 160 ml of an aqueous solution comprising 34.0 g of potassium brormide and 8.9 mg of potassium hexacyano ferrite (II) over 30 minutes.

Then, the resulting mixture was cooled and desalted, and to this was added gelatin of 7 weight % of the entire mixture to adjust the pH value of the mixture to 6.2, to prepare an emulsion A-1. The emulsion A-1 was composed of hexagonal tabular grains having an average grain size that was defined as the average diameter of spheres having equivalent grain volume (hereinafter referred to as "equivalent sphere diameter") of 1.15 μm, an average thickness of 0.12 μm, and an aspect ratio of 24.0.

(ii) Preparation of Emulsions A-2 and A-3

Emulsions A-2 and A-3 were prepared in the same manner as the emulsion A-1, except that the number of nuclei was changed by controlling amount of silver nitrate and potassium bromide added at the initial stage of grain-formation. Incidentally, the amount of potassium hexachloro iridate (IV) and potassium hexacyano ferrite (II) was changed in inverse proportion to the volume of grains, and the amount of sodium p-iodoacetamidobenzene sulfonate monohydrate was changed in proportion to the peripheral length of the grains. The emulsion A-2 was composed of hexagonal tabular grains having an average grain size that was defined as equivalent sphere diameter of 0.75 μm, an average thickness of 0.11 μm, and an aspect ratio of 14.0. The emulsion A-3 was composed of hexagonal tabular grains having an average grain size that was defined as equivalent sphere diameter of 0.52 μm, an average thickness of 0.09 μm, and an aspect ratio of 11.3.

(iii) Chemical Sensitization and Spectral Sensitization

To the emulsion A-1 was added 5.6 ml of potassium iodide 1% aqueous solution at 40° C., and then, added $8.2\times10^{-4}$ mol/mol-Ag of the following blue-sensitizing dye, the following compound 1, potassium thiocyanate, chloro auric acid, sodium thiosulfate and mono(pentafluorophenyl) diphenyl phosphine selenide, whereby the emulsion A-1 was subjected to spectral sensitization and chemical sensitization. Herein, the amount of each chemical sensitizer was controlled such that the optimum chemical sensitivity of the emulsion was obtained. After the sensitization, to the sensitized emulsion was added the following stabilizer S (mixture), to prepare a blue-sensitive emulsion A-1b.

Blue-Sensitizing Dye

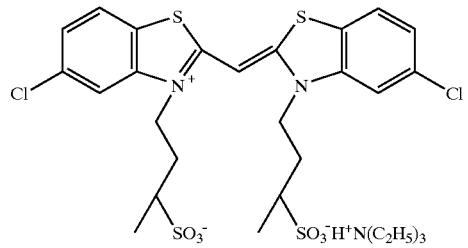

Compound 1

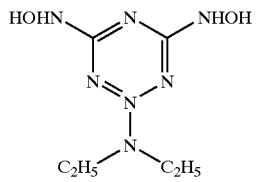

Stabilizer S (Mixture of Following Compounds)

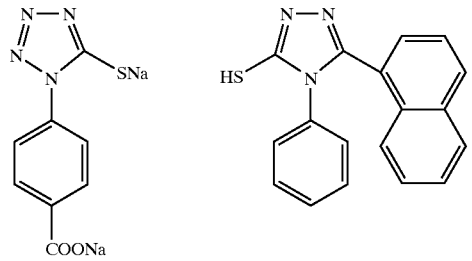

$2\times10^{-4}$ mol per 1 mol-Ag of Emulsion A-1 | $8\times10^{-5}$ mol per 1 mol-Ag of Emulsion A-1

Blue-sensitive emulsions A-2b and A-3b were prepared in the same manner as the blue-sensitive emulsion A-1b except for using the emulsions A-2 and A-3 instead of the emulsion A-1, respectively. Incidentally, the amount of sensitizing dye was changed in accordance with the surface area of silver halide grains in each emulsion, and the amount of the chemical sensitizer was also changed such that the optimum chemical sensitivity of the emulsion was obtained.

Further, green-sensitive emulsions A-1g, A-2g and A-3g, and red-sensitive emulsions A-1r, A-2r and A-3r were prepared in the same manner as the blue-sensitive emulsions A-1b, A-2b and A-3b instead of using the following sensitizing dye instead of the above blue-sensitizing dye, respectively.

Green-Sensitizing Dye I

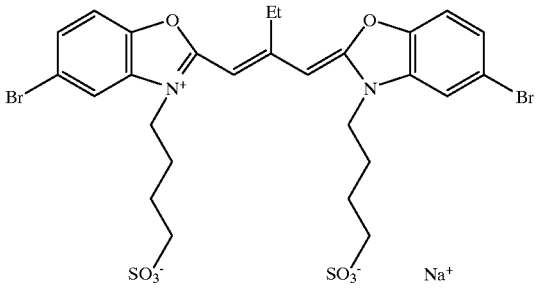

$5.5\times10^{-4}$ mol per 1 mol-Ag of Emulsion A-1

-continued

Green-Sensitizing Dye II

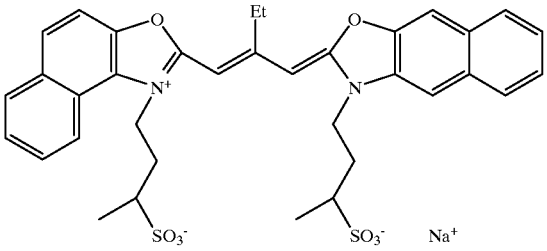

1.3 x $10^{-4}$ mol per
1 mol-Ag of Emulsion A-1

Green-Sensitizing Dye III

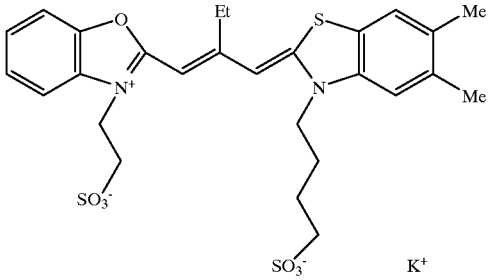

4.8 x $10^{-5}$ mol per
1 mol-Ag of Emulsion A-1

Red-Sensitizing Dye I

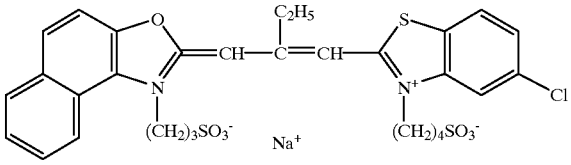

2.5 x $10^{-4}$ mol per
1 mol-Ag of Emulsion A-1

Red-Sensitizing Dye II

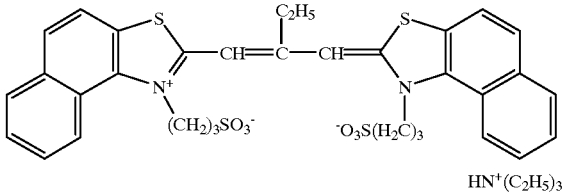

6.3 x $10^{-5}$ mol per
1 mol-Ag of Emulsion A-1

Red-Sensitizing Dye III

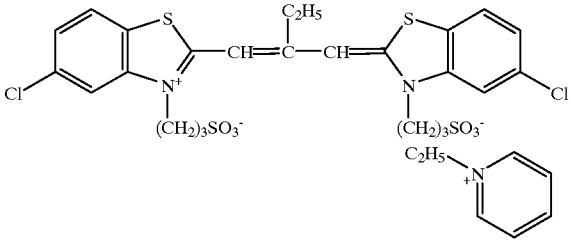

3.1 x $10^{-4}$ mol per
1 mol-Ag of Emulsion A-1

(d) Preparation of Fatty Acid Silver Salt Dispersion 87.6 g of behenic acid ("Edenor C22-85R" manufactured by HENKEL Ltd.), 423 ml of distilled water, 49.2 ml of a 5N NaOH aqueous solution and 120 ml of t-butanol were mixed and reacted at 75° C. for 1 hour while stirring, to provide a sodium behenate solution. 206.2 ml of a silver nitrate aqueous solution (pH 4.0) comprising 40.4 g of silver nitrate was prepared and kept at 10° C. Then, the whole amount of the sodium behenate solution and the whole amount of the silver nitrate aqueous solution were added to a mixture of 635 ml of distilled water and 30 ml of t-butanol at 30° C. while stirring at a constant flow rate over 62 minutes and 10 seconds and 60 minutes, respectively. At that time, only the silver nitrate aqueous solution was added over 7 minutes and 20 seconds, both of the sodium behenate solution and the silver nitrate aqueous solution were added over 52 minutes and 40 seconds thereafter, and then, only the sodium behenate solution was added over 9 minutes and 30 seconds. Temperature of the mixture was maintained at approximately 30° C. by controlling the outer temperature. Further, the pipes for adding the silver behenate solution were maintained with respect to the temperature by a steam tracing, and the temperature of the silver behenate solution to be added was maintained at 75° C. by controlling opening of a nozzle for the steam. The pipes for adding the silver nitrate aqueous solution were maintained with respect to the temperature by circulating cold water at the outer side of double pipes. The pipes for the silver behenate solution and the pipes for the silver nitrate aqueous solution were symmetrically provided centering around a stirring shaft such that they did not come into contact with the reaction mixture.

After adding the silver behenate solution and the silver nitrate aqueous solution, the resulting mixture was stirred for 20 minutes and cooled to 25° C. Then, solid content of the mixture was separated by suction filtration, and washed until the electric conductivity thereof became 30 $\mu$S/cm, to prepare a fatty acid silver salt. Thus-obtained fatty acid silver salt was stored in the form of a wet cake without drying.

The resultant silver behenate grains had a scaly shape, an average equivalent sphere diameter of 0.52 $\mu$m and coefficient of variation of 15% in terms of the equivalent sphere diameter. Herein, the shape of the silver behenate grains was measured by an electron microphotography.

To the wet cake comprising 100 g of the solid content was added 7.4 g of poly(vinyl alcohol) "PVA-217" and water such that the total weight was 385 g, and the resultant was preliminary-dispersed by a homomixer. Then, the resulting, preliminary-dispersed mixture was subjected to a dispersing treatment using a dispersing machine three times while adjusting the pressure of the dispersing machine to 1750 kg/cm$^2$, to prepare a silver behenate dispersion. Used as the dispersing machine was "Microfluidizer M-110S-EH" using a G10Z Interaction chamber, manufactured by Microfluidex International Corporation. Incidentally, the dispersing temperature was adjusted at 18° C. by disposing coiled heat exchangers in front and rear of the interaction chamber, respectively, and by controlling a temperature of the refrigerant.

(e) Preparation of Silver 5-Amino-3-Benzylthiotriazole Emulsion 11.3 g of 5-amino-3-benzylthiotriazole, 1.1 g of sodium hydroxide and 10 g of gelatin were dissolved in 1000 ml of water and stirred at 50° C. Then, to the resultant aqueous solution was added a solution of 8.5 g of silver nitrate and 100 ml of water over 2 minutes. An emulsion was precipitated and desalted by controlling the pH value of thus-obtained solution. The pH value of the emulsion was adjusted to 6.0, to prepare 400 g of a silver 5-amino-3-benzylthiotriazole emulsion.

(f) Preparation of Dispersion of Organo-Polyhalogen Compound (1)

5 kg of tribromomethylnaphthyl sulfone (organo-polyhalogen compound (1)), 2.5 kg of an aqueous solution comprising 20 weight % of a modified poly(vinyl alcohol) "POVAL MP203" manufactured by Kuraray Co., Ltd., 213 g of an aqueous solution comprising 20 weight % of sodium triisopropylnaphthalene sulfonate and 10 kg of water were well mixed to provide a slurry. The slurry was transmitted by a diaphragm pump to a horizontal-type sand mill "UVM-2" manufactured by IMEX Co. that was packed with zirconium beads having an average diameter of 0.5 mm, dispersed therein for 5 hours. Then, to the slurry was added 0.2 g of a sodium salt of benzoisothiazolinone and water so that the concentration of the organo-polyhalogen compound (1) was adjusted to 20 weight %, to prepare a dispersion of the organo-polyhalogen compound (1). The dispersion comprised organo-polyhalogen compound grains having the median size of 0.36 μm and the maximum grain size of 2.0 μm or less. The resultant dispersion was filtrated by a polypropylene filter having a hole size of 3.0 μm to remove extraneous substances such as dust, and stored.

(g) Preparation of Dispersion of Organo-Polyhalogen Compound (2)

A dispersion of a tribromomethyl(4-(2,4,6-trimethylphenylsulfonyl)phenyl)sulfone (organo-polyhalogen compound (2)) was prepared in the same manner as the dispersion of the organo-polyhalogen compound (1) except that 5 kg of tribromomethyl(4-(2,4,6-trimethylphenylsulfonyl)phenyl)sulfone was used instead of 5 kg of tribromomethylnaphthyl sulfone, and that to the slurry was added 0.2 g of a sodium salt of benzoisothiazolinone and water so that the concentration of the organo-polyhalogen compound was adjusted to 25 weight %. The dispersion of the organo-polyhalogen compound (2) comprised organo-polyhalogen compound grains having the median size of 0.38 μm and the maximum grain size of 2.0 μm or less. The resultant dispersion was filtrated by a polypropylene filter having a hole size of 3.0 μm to remove extraneous substances such as dust, and stored.

(h) Preparation of Dispersion of Organo-Polyhalogen Compound (3)

A dispersion of a tribromomethylphenyl sulfone (organo-polyhalogen compound (3)) was prepared in the same manner as the dispersion of the organo-polyhalogen compound (1) except that 5 kg of tribromomethylphenyl sulfone was used instead of 5 kg of tribromomethylnaphthyl sulfone, that the amount of the aqueous solution comprising 20 weight % of a modified poly(vinyl alcohol) was 5 kg, and that to the slurry was added 0.2 g of a sodium salt of benzoisothiazolinone and water so that the concentration of the organo-polyhalogen compound was adjusted to 30 weight %. The dispersion of the organo-polyhalogen compound (3) comprised organo-polyhalogen compound grains having the median size of 0.41 μm and the maximum grain size of 2.0 μm or less. The resultant dispersion was filtrated by a polypropylene filter having a hole size of 3.0 μm to remove extraneous substances such as dust, and stored at 10° C. or less.

(i) Preparation of Emulsified Dispersion Comprising Coupler and Color-Developing Agent 8.95 g of the yellow coupler CP-107 and 3.65 g of the following compound DEVP-23 were dissolved in 6.30 g of the following high boiling point organic solvent (g) and 50.0 ml of ethyl acetate at 60° C. The resulting solution was mixed with 200 g of an aqueous solution in which 18.0 g of a lime-treated gelatin and 0.8 g of sodium dodecylbenzene sulfonate were dissolved, and emulsified dispersed at 10,000 r.p.m. for 20 minutes by means of a Dissolver stirrer. After dispersion, distilled water was added to the resultant mixture so as to make the total amount 300 g, and stirred for 10 minutes at 2,000 r.p.m., to prepare an emulsified dispersion comprising the yellow coupler CP-107 and the compound DEVP-23.

8.95 g of the yellow coupler CP-107, 10.77 g of the following compound DEVP-26, 0.17 g of the following antifoggant (d) and 0.28 g of the following antifoggant (e) were dissolved in 9.08 g of the following high boiling point organic solvent (f) and 50.0 ml of ethyl acetate at 60° C. The resulting solution was mixed with 200 g of an aqueous solution in which 18.0 g of a lime-treated gelatin and 0.8 g of sodium dodecylbenzene sulfonate were dissolved, and emulsified dispersed at 10,000 r.p.m. for 20 minutes by means of a Dissolver stirrer. After dispersion, distilled water was added to the resultant mixture so as to make the total amount 300 g, and stirred for 10 minutes at 2,000 r.p.m., to prepare an emulsified dispersion comprising the yellow coupler CP-107 and the compound DEVP-26.

Emulsified dispersions comprising magenta or cyan coupler were prepared in the same manner as the above. 4.68 g of the magenta coupler CP-205, 2.38 g of the magenta coupler CP-210 and 2.74 g of the compound DEVP-23 were dissolved in 9.76 g of the high boiling point organic solvent (g) and 38.0 ml of ethyl acetate at 60° C. The resulting solution was mixed with 150 g of an aqueous solution in which 12.2 g of a lime-treated gelatin and 0.8 g of sodium dodecylbenzene sulfonate were dissolved, and emulsified dispersed at 10,000 r.p.m. for 20 minutes by means of a Dissolver stirrer. After dispersion, distilled water was added to the resultant mixture so as to make the total amount 300 g, and stirred for 10 minutes at 2,000 r.p.m., to prepare an emulsified dispersion comprising the magenta coupler CP-205, the magenta coupler CP-210 and the compound DEVP-23.

4.68 g of the magenta coupler CP-205, 2.38 g of the magenta coupler CP-210, 8.13 g of the compound DEVP-26 and 0.11 g of the antifoggant (d) were dissolved in 7.52 g of the following high boiling point organic solvent a and 38.0 ml of ethyl acetate at 60° C. The resulting solution was mixed with 150 g of an aqueous solution in which 12.2 g of a lime-treated gelatin and 0.8 g of sodium dodecylbenzene sulfonate were dissolved, and emulsified dispersed at 10,000 r.p.m. for 20 minutes by means of a Dissolver stirrer. After dispersion, distilled water was added to the resultant mixture so as to make the total amount 300 g, and stirred for 10 minutes at 2,000 r.p.m., to prepare an emulsified dispersion comprising the magenta coupler CP-205, the magenta coupler CP-210 and the compound DEVP-26.

7.30 g of the cyan coupler CP-320, 3.09 g of the cyan coupler CP-324 and 4.3 g of the compound DEVP-23 were dissolved in 11.62 g of the high boiling point organic solvent (g) and 38.0 ml of ethyl acetate at 60° C. The resulting solution was mixed with 150 g of an aqueous solution in which 12.2 g of a lime-treated gelatin and 0.8 g of sodium dodecylbenzene sulfonate were dissolved, and emulsified dispersed at 10,000 r.p.m. for 20 minutes by means of a Dissolver stirrer. After dispersion, distilled water was added to the resultant mixture so as to make the total amount 300 g, and stirred for 10 minutes at 2, 000 r.p.m., to prepare an emulsified dispersion comprising the cyan coupler CP-320, the cyan coupler CP-324 and the compound DEVP-23.

7.30 g of the cyan coupler CP-320, 3.09 g of the cyan coupler CP-324, 12.85 g of the compound DEVP-26 and 0.15 g of the antifoggant (d) were dissolved in 11.62 g of the high boiling point organic solvent (j) and 38.0 ml of ethyl acetate at 60° C. The resulting solution was mixed with 150 g of an aqueous solution in which 12.2 g of a lime-treated gelatin and 0.8 g of sodium dodecylbenzene sulfonate were dissolved, and emulsified dispersed at 10,000 r.p.m. for 20 minutes by means of a Dissolver stirrer. After dispersion, distilled water was added to the resultant mixture so as to make the total amount 300 g, and stirred for 10 minutes at 2,000 r.p.m., to prepare an emulsified dispersion comprising the cyan coupler CP-320, the cyan coupler CP-324 and the compound DEVP-26.

DEVP-23

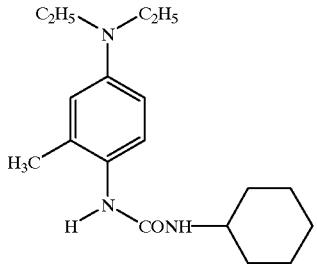

DEVP-26

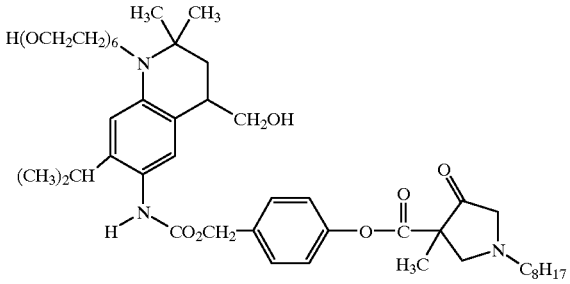

High Boiling Point Organic Solvent (g)

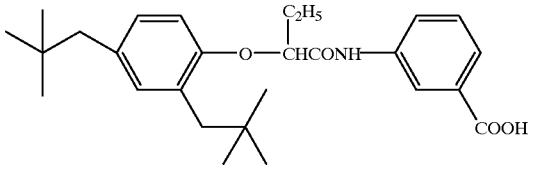

High Boiling Point Organic Solvent (f)

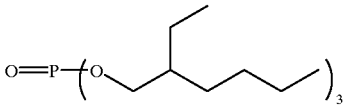

High Boiling Point Organic Solvent (j)

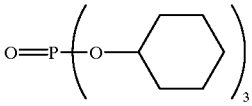

Antifoggant (d)

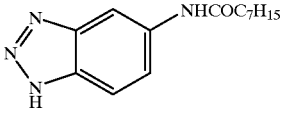

-continued

Antifoggant (e)

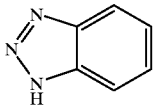

(j) Preparation of Substrate 100 parts by weight of polyethylene-2,6-naphthalene dicarboxylate (PEN) and 2 parts by weight of an ultraviolet absobant "Tinuvin P. 326" manufactured by Ciba-Geigy were uniformly mixed, and fuised at 300° C. Then, the fused mixture was extruded from a T-die, stretched 3.3 times in the longitudinal direction and 4.0 times in the horizontal direction at 140° C., and subjected to thermal fixation at 250° C. for 6 seconds, to prepare a PEN film having a thickness of 90 μm. Incidentally, to the PEN film was added a suitable amount of a blue dyestuff, a magenta dyestuff and a yellow dyestuff (I-1,I-4, I-6, I-24, I-26, I-27 and II-5 described in Koukaigihou (Journal of Technical Disclosure), Kougi No. 94-6023). Then, the PEN film was wound around a stainless winding core having a diameter of 30 cm and subject to thermal history at 110° C. for 48 hours, to prepare a substrate, which does not tend to curl (core-set curl).

An undercoat layer, an antistatic layer (back first layer), a magnetic recording layer (back second layer) and a back third layer were disposed on the substrate.

(i) Undercoat Layer

A glow discharge was applied onto both surfaces of the PET substrate according to the following method.

Four cylindrical electrodes each having a diameter of 2 cm and a length of 40 cm were set at intervals of 10 cm on an insulating plate in a vacuum tank. At this time, the substrate was disposed so as to run at the distance of 15 cm apart from the cylindrical electrodes. Further, a heat roll equipped with a thermoregulator having a diameter of 50 cm was set just in front of the cylindrical electrodes, and the substrate was disposed so as to contact with the heat roll making ¾ round. A biaxially stretched substrate of 90 μm in thickness and 30 cm in width was run and heated by the heat roll so that the temperature on the surfaces of the substrate became 115° C. between the heat roll and the electrode zone. Then, the heated substrate was conveyed at the rate of 15 cm per second to be subjected to a glow discharge processing. Additional conditions for the glow discharge processing were as follows:

| | |
|---|---|
| Pressure in the vacuum tank | 26.5 Pa |
| Partial pressure of $H_2O$ in the atmospheric gas | 75% |
| Discharge frequency | 30 kHz |
| Output | 2500 W |
| Processing intensity | 0.5 kV · A · min./$m_2$ |

As the electrode for a vacuum glow discharge, one described in Japanese Patent laid-Open No. 7-3056 was used.

The emulsion layer side surface of the glow-processed PEN substrate was coated with a liquid having the following composition and dried at 115° C. for 3 minutes, to dispose an undercoat layer. The liquid for the undercoat layer was applied so that the dry thickness of the undercoat layer was 0.02 μm.

| Composition of Liquid for Undercoat Layer | |
|---|---|
| Gelatin | 83 parts by weight |
| Water | 291 parts by weight |
| Salicylic Acid | 18 parts by weight |
| Colloidal Silica "Aerosil R972" Manufactured by Nippon Aerosil Co., Ltd. | 1 part by weight |
| Methanol | 6900 parts by weight |
| n-Propanol | 830 parts by weight |
| Polyamido-Epichlorohydrin Resin Described in Japanese Patent Laid-Open No. 51-3619 | 25 parts by weight |

(ii) Antistatic Layer (Back First Layer)

A mixture of 40 parts by weight of conductive fine particles "SN-100" manufactured by Ishihara Sangyo Kaisha, Ltd. and 60 parts by weight of water was roughly dispersed by a stirrer while adding an aqueous solution of 1 N sodium hydroxide thereto. The mixture was dispersed by means of a horizontal type sand mill to prepare a dispersion having pH of 7.0 of the conductive fine particles having an average particle diameter of 0.06 $\mu$m in terms of secondary particles. Then, the back side surface of the surface-treated PEN substrate was coated with a liquid having the following composition so that the coating amount of the conductive fine particles was 270 mg/m$^2$, and dried at 115° C. for 3 minutes, to dispose an antistatic layer (back first layer).

| Composition of Liquid for Antistatic Layer | |
|---|---|
| Conductive Fine Particles "SN-100" Manufactured by Ishihara Sangyo Kaisha, Ltd. | 270 parts by weight |
| Gelatin | 23 parts by weight |
| Surfactant "LEODOL TW-L 120" Manufactured by Kao Corporation | 6 parts by weight |
| Hardener "DENACOL EX-521" manufactured by NAGASE KASEI Chemicals Ltd. | 9 parts by weight |
| Water | 5000 parts by weight |

(iii) Magnetic Recording Layer (Back Second Layer)

The surface of magnetic particles of Co-deposited $\gamma$-$Fe_2O_3$ "CSF-4085 V2" manufactured by Toda Kogyo Co., Ltd. was treated with a silane coupling agent "X-12-641" manufactured by Shinetsu Chemical to., Ltd. The weight ratio of the silane coupling agent to the magnetic particles was 16 weight %. Then, the back first layer was coated with a liquid having the following composition so that the coating amount of the magnetic particles treated with the silane coupling agent was 62 mg/m$^2$, and dried at 115° C. for 1 minute, to dispose a magnetic recording layer (back second layer). Dispersion of the magnetic particles and abrasives was carried out according to a method described in Japanese Patent Laid-Open No. 6-03 5092. Increase in color density of DB of the magnetic recording layer by X-light (blue filter) was approximately 0.1, and the magnetic recording layer had a saturated magnetizing moment of 4.2 emu/g, a coercivity of 7.3×10$^4$ A/m and rectangularity of 65%.

| Composition of Liquid for Magnetic Recording Layer | |
|---|---|
| Diacetyl Cellulose (Binder) | 1140 parts by weight |
| Magnetic Particles "CSF-4085 V2" Treated with "X-12-641" | 62 parts by weight |
| Alumina "AKP-50" Manufactured by Sumitomo Chemical Co., Ltd. (Abrasives) | 40 parts by weight |

-continued

| Composition of Liquid for Magnetic Recording Layer | |
|---|---|
| Hardener "millionate MR-400" Manufactured by Nippon Polyurethane Industry Co., Ltd. | 71 parts by weight |
| Cyclohexanone | 12000 parts by weight |
| Methylethyl Ketone | 12000 parts by weight |

(iv) Back Third Layer

The following wax (1-2) was emulsified dispersed in water by means of a high pressure homogenizer to prepare an aqueous dispersion of wax having a concentration of 10 weight % and a weight average diameter of 0.25 $\mu$m.

Wax (1-2)

n-$C_{17}H_{35}COOC_{40}H_{81}$-n

Then, the back second layer was coated with a liquid having the following composition so that the coating amount of the wax was 27 mg/m$^2$, and dried at 115° C. for 1 minute, to dispose a back third layer.

| Composition of Liquid for Back Third Layer | |
|---|---|
| Above-Described Aqueous Dispersion of 10 weight % Wax | 270 parts by weight |
| Pure Water | 176 parts by weight |
| Ethanol | 7123 parts by weight |
| Cyclohexanone | 841 parts by weight |

(k) Production of Photosensitive Material

Using the above-mentioned dispersions, emulsions and substrate, the reversibly decolorable colored dispersion for an antihalation layer prepared in Example 1, the compounds shown below, etc., heat-developable color photosensitive materials (color photothermographic materials) 101 and 102 each having a multi-layer structure shown in Table 1 were produced, respectively.

Surfactant (q)

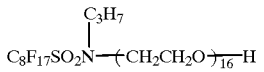

Surfactant (r)

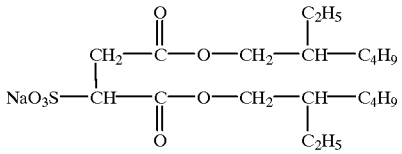

Surfactant (y)

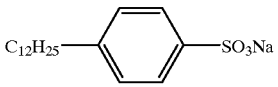

Hardener (t)

Water-Soluble Polymer (s)

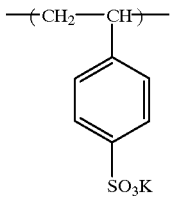

-continued

Formalin Scavenger (u)

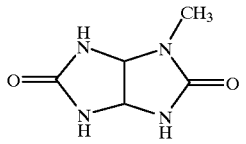

TABLE 1

Composition of Each Layer of Color Photothermographic Material (Part by Weight).

| Color Photothermographic Material 101 | | Color Photothermographic Material 102 | |
|---|---|---|---|
| **Protective Layer** | | | |
| Lime-Treated Gelatin | 914 | Lime-Treated Gelatin | 914 |
| Mailing Agent (Silica) | 50 | Matting Agent (Silica) | 50 |
| Surfactant (q) | 30 | Surfactant (q) | 30 |
| Surfactant (r) | 40 | Surfactant (r) | 40 |
| Water-Soluble Polymer (s) | 15 | Water-Soluble Polymer (s) | 15 |
| Hardener (t) | 110 | Hardener (t) | 110 |
| **Intermediate Layer** | | | |
| Lime-Treated Gelatin | 600 | Lime-Treated Gelatin | 461 |
| Surfactant (r) | 5 | Surfactant (r) | 5 |
| 4-Methylphthalic Acid | 102 | | |
| Phthalic Acid | 282 | | |
| Formalin Scavenger (u) | 300 | Formalin Scavenger (u) | 300 |
| D-Sorbitol | 50 | D-Sorbitol | 50 |
| Water-Soluble Polymers (s) | 15 | Water-Soluble Polymers (s) | 15 |
| **High Sensitive, Yellow Color-Forming Layer** | | | |
| Lime-Treated Gelatin | 1750 | Lime-Treated Gelatin | 1750 |
| Emulsion A-1b (Silver Amount) | 550 | Emulsion A-1b (Silver Amount) | 550 |
| Silver Behenate | 1600 | Silver 5-Amino-3-Benzylthiotriazole | 165 |
| 1-Phenyl-2-Heptyl-5-Mercapto-1,3,4-Triazole | 32 | | |
| Yellow Coupler CP-107 | 179 | Yellow Coupler CP-107 | 179 |
| DEVP-23 | 73 | DEVP-26 | 215 |
| 6-Isopropylphthalazine | 185 | | |
| Organo-Polyhalogen Compound (1) | 127 | | |
| Organo-Polyhalogen Compound (2) | 41 | Antifoggant (d) | 3.4 |
| Organo-Polyhalogen Compound (3) | 42 | Antifoggant (e) | 5.6 |
| High Boiling Point Organic Solvent (g) | 126 | High Boiling Point Organic Solvent (f) | 182 |
| Surfactant (y) | 27 | Surfactant (y) | 27 |
| D-Sorbitol | 200 | D-Sorbitol | 200 |
| Water-Soluble Polymer (s) | 1 | Water-Soluble Polymer (s) | 1 |
| Modified POVAL MP203 | 226 | | |
| Modified Poly(vinyl-alcohol) "PVA217" | 118 | | |
| **Middle Sensitive, Yellow Color-Forming Layer** | | | |
| Lime-Treated Gelatin | 1470 | Lime-Treated Gelatin | 1470 |
| Emulsion A-2b (Silver Amount) | 263 | Emulsion A-2b (Silver Amount) | 263 |
| Silver Behenate | 1600 | Silver 5-Amino-3-Benzylthiotriazole | 185 |
| 1-Phenyl-2-Heptyl-5-Mercapto-1,3,4-Triazole | 32 | | |
| Yellow Coupler CP-107 | 269 | Yellow Coupler CP-107 | 269 |
| DEVP-23 | 109 | DEVP-26 | 323 |
| 6-Isopropylphthalazine | 185 | | |
| Organo-Polyhalogen Compound (1) | 127 | | |
| Organo-Polyhalogen Compound (2) | 41 | Antifoggant (d) | 5.1 |
| Organo-Polyhalogen Compound (3) | 42 | Antifoggant (e) | 8.4 |

TABLE 1-continued

Composition of Each Layer of Color Photothermographic Material (Part by Weight).

| Color Photothermographic Material 101 | | Color Photothermographic Material 102 | |
|---|---|---|---|
| High Boiling Point Organic Solvent (g) | 189 | High Boiling Point Organic Solvent (f) | 272 |
| Surfactant (y) | 26 | Surfactant (y) | 26 |
| D-Sorbitol | 150 | D-Sorbitol | 150 |
| Water-Soluble Polymer (s) | 2 | Water-Soluble Polymer (s) | 2 |
| Modified POVAL MP203 | 251 | | |
| Modified Poly(vinyl-alcohol) "PVA217" | 118 | | |
| **Low Sensitive, Yellow Color-Forming Layer** | | | |
| Lime-Treated Gelatin | 1680 | Lime-Treated Gelatin | 1680 |
| Emulsion A-3b (Silver Amount) | 240 | Emulsion A-3b (Silver Amount) | 240 |
| Silver Behenate | 1334 | Silver 5-Amino-3-Benzylthiotriazole | 206 |
| 1-Phenyl-2-Heptyl-5-Mercapto-1,3,4-Triazole | 27 | | |
| Yellow Coupler CP-107 | 448 | Yellow Coupler CP-107 | 448 |
| DEVP-23 | 182 | DEVP-26 | 539 |
| 6-Isopropylphthalazine | 154 | | |
| Organo-Polyhalogen Compound (1) | 106 | | |
| Organo-Polyhalogen Compound (2) | 34 | Antifoggant (d) | 8.5 |
| Organo-Polyhalogen Compound (3) | 35 | Antifoggant (e) | 14 |
| High Boiling Point Organic Solvent (g) | 315 | High Boiling Point Organic Solvent (f) | 454 |
| Surfactant (y) | 30 | Surfactant (y) | 30 |
| D-Sorbitol | 150 | D-Sorbitol | 150 |
| Water-Soluble Polymer (s) | 3 | Water-Soluble Polymer (s) | 3 |
| Modified POVAL MP203 | 272 | | |
| Modified Poly(vinyl-alcohol) "PVA217" | 99 | | |
| **Intermediate Layer (Yellow Filter Layer)** | | | |
| Lime-Treated Gelatin | 1120 | Lime-Treated Gelatin | 1120 |
| Surfactant (y) | 15 | Surfactant (y) | 15 |
| Surfactant (r) | 24 | Surfactant (r) | 24 |
| Leuco Dye (7) | 220 | Leuco Dye (7) | 220 |
| Developer PH-1 | 250 | Developer PH-1 | 250 |
| Stearyl Alcohol | 450 | Stearyl Alcohol | 450 |
| Water-Soluble Polymer (s) | 15 | Water-Soluble Polymer (s) | 15 |
| **High Sensitive, Magenta Color-Forming Layer** | | | |
| Lime-Treated Gelatin | 781 | Lime-Treated Gelatin | 781 |
| Emulsion A-1g (Silver Amount) | 488 | Emulsion A-1g (Silver Amount) | 488 |
| Silver Behenate | 803 | Silver 5-Amino-3-Benzylthiotriazole | 62 |
| 1-Phenyl-2-Heptyl-5-Mercapto-1,3,4-Triazole | 16 | | |
| Magenta Coupler CP-205 | 47 | Magenta Coupler CP-205 | 47 |
| Magenta Coupler CP-210 | 24 | Magenta Coupler CP-210 | 24 |
| DEVP-23 | 27 | DEVP-26 | 81 |
| 6-Isopropylphthalazine | 93 | | |
| Organo-Polyhalogen Compound (1) | 64 | | |
| Organo-Polyhalogen Compound (2) | 21 | | |
| Organo-Polyhalogen Compound (3) | 21 | Antifoggant (d) | 1.1 |
| High Boiling Point Organic Solvent (g) | 98 | High Boiling Point Organic Solvent (j) | 75 |
| Surfactant (y) | 8 | Surfactant (y) | 8 |
| D-Sorbitol | 100 | D-Sorbitol | 100 |
| Water-Soluble Polymer (s) | 8 | Water-Soluble Polymer (s) | 8 |
| Modified POVAL MP203 | 108 | | |
| Modified Poly(vinyl-alcohol) "PVA217" | 59 | | |

TABLE 1-continued

Composition of Each Layer of Color Photothermographic Material (Part by Weight).

| Color Photothermographic Material 101 | | Color Photothermographic Material 102 | |
|---|---|---|---|
| **Middle Sensitive, Magenta Color-Forming Layer** | | | |
| Lime-Treated Gelatin | 659 | Lime-Treated Gelatin | 659 |
| Emulsion A-2g (Silver Amount) | 492 | Emulsion A-2g (Silver Amount) | 492 |
| Silver Behenate | 803 | Silver 5-Amino-3-Benzylthiotriazole | 93 |
| 1-Phenyl-2-Heptyl-5-Mercapto-1,3,4-Triazole | 16 | | |
| Magenta Coupler CP-205 | 94 | Magenta Coupler CP-205 | 94 |
| Magenta Coupler CP-210 | 48 | Magenta Coupler CP-210 | 48 |
| DEVP-23 | 55 | DEVP-26 | 163 |
| 6-Isopropylphthalazine | 93 | | |
| Organo-Polyhalogen Compound (1) | 64 | | |
| Organo-Polyhalogen Compound (2) | 21 | | |
| Organo-Polyhalogen Compound (3) | 21 | Antifoggant (d) | 2.2 |
| High Boiling Point Organic Solvent (g) | 196 | High Boiling Point Organic Solvent (j) | 150 |
| Surfactant (y) | 11 | Surfactant (y) | 11 |
| D-Sorbitol | 80 | D-Sorbitol | 80 |
| Water-Soluble Polymer (s) | 14 | Water-Soluble Polymer (s) | 14 |
| Modified POVAL MP203 | 127 | | |
| Modified Poly(vinyl-alcohol) "PVA217" | 59 | | |
| **Low Sensitive, Magenta Color-Forming Layer** | | | |
| Lime-Treated Gelatin | 711 | Lime-Treated Gelatin | 711 |
| Emulsion A-3g (Silver Amount) | 240 | Emulsion A-3g (Silver Amount) | 240 |
| Silver Behenate | 1003 | Silver 5-Amino-3-Benzylthiotriazole | 155 |
| 1-Phenyl-2-Heptyl-5-Mercapto-1,3,4-Triazole | 20 | | |
| Magenta Coupler CP-205 | 234 | Magenta Coupler CP-205 | 234 |
| Magenta Coupler CP-210 | 119 | Magenta Coupler CP-210 | 119 |
| DEVP-23 | 137 | DEVP-26 | 407 |
| 6-Isopropylphthalazine | 116 | | |
| Organo-Polyhalogen Compound (1) | 80 | | |
| Organo-Polyhalogen Compound (2) | 26 | | |
| Organo-Polyhalogen Compound (3) | 27 | Antifoggant (d) | 5.5 |
| High Boiling Point Organic Solvent (g) | 490 | High Boiling Point Organic Solvent (j) | 376 |
| Surfactant (y) | 29 | Surfactant (y) | 29 |
| D-Sorbitol | 80 | D-Sorbitol | 80 |
| Water-Soluble Polymer (s) | 14 | Water-Soluble Polymer (s) | 14 |
| Modified POVAL MP203 | 208 | | |
| Modified Poly(vinyl-alcohol) "PVA217" | 74 | | |
| **Intermediate Layer (Magenta Filter Layer)** | | | |
| Lime-Treated Gelatin | 850 | Lime-Treated Gelatin | 850 |
| Surfactant (y) | 15 | Surfactant (y) | 15 |
| Surfactant (r) | 24 | Surfactant (r) | 24 |
| Leuco Dye (22) | 170 | Leuco Dye (22) | 170 |
| Developer PH-1 | 163 | Developer PH-1 | 163 |
| Stearyl Alcohol | 294 | Stearyl Alcohol | 294 |
| Formalin Scavenger (u) | 300 | Formalin Scavenger (u) | 300 |
| D-Sorbitol | 80 | D-Sorbitol | 80 |
| Water-Soluble Polymer (s) | 15 | Water-Soluble Polymer (s) | 15 |
| **High Sensitive, Cyan Color-Forming Layer** | | | |
| Lime-Treated Gelatin | 842 | Lime-Treated Gelatin | 842 |
| Emulsion A-1r (Silver Amount) | 550 | Emulsion A-1r (Silver Amount) | 550 |
| Silver Behenate | 762 | Silver 5-Amino-3-Benzylthiotriazole | 59 |

TABLE 1-continued

Composition of Each Layer of Color Photothermographic Material (Part by Weight).

| Color Photothermographic Material 101 | | Color Photothermographic Material 102 | |
|---|---|---|---|
| 1-Phenyl-2-Heptyl-5-Mercapto-1,3,4-Triazole | 15 | | |
| Cyan Coupler CP-320 | 19 | Cyan Coupler CP-320 | 19 |
| Cyan Coupler CP-324 | 44 | Cyan Coupler CP-324 | 44 |
| DEVP-23 | 26 | DEVP-26 | 77 |
| 6-Isopropylphthalazine | 88 | | |
| Organo-Polyhalogen Compound (1) | 61 | | |
| Organo-Polyhalogen Compound (2) | 20 | | |
| Organo-Polyhalogen Compound (3) | 20 | Antifoggant (d) | 0.9 |
| High Boiling Point Organic Solvent (g) | 88 | High Boiling Point Organic Solvent (j) | 70 |
| Surfactant (y) | 29 | Surfactant (y) | 5 |
| D-Sorbitol | 80 | D-Sorbitol | 80 |
| Water-Soluble Polymer (s) | 14 | Water-Soluble Polymer (s) | 18 |
| Modified POVAL MP203 | 101 | | |
| Modified Poly(vinyl-alcohol) "PVA217" | 56 | | |
| **Middle Sensitive, Cyan Color-Forming Layer** | | | |
| Lime-Treated Gelatin | 475 | Lime-Treated Gelatin | 475 |
| Emulsion A-2r (Silver Amount) | 600 | Emulsion A-2r (Silver Amount) | 600 |
| Silver Behenate | 1143 | Silver 5-Amino-3-Benzylthiotriazole | 132 |
| 1-Phenyl-2-Heptyl-5-Mercapto-1,3,4-Triazole | 23 | | |
| Cyan Coupler CP-320 | 56 | Cyan Coupler CP-320 | 56 |
| Cyan Coupler CP-324 | 131 | Cyan Coupler CP-324 | 131 |
| DEVP-23 | 78 | DEVP-26 | 231 |
| 6-Isopropylphthalazine | 132 | | |
| Organo-Polyhalogen Compound (1) | 91 | | |
| Organo-Polyhalogen Compound (2) | 29 | | |
| Organo-Polyhalogen Compound (3) | 30 | Antifoggant (d) | 2.7 |
| High Boiling Point Organic Solvent (g) | 209 | High Boiling Point Organic Solvent (j) | 209 |
| Surfactant (y) | 29 | Surfactant (y) | 10 |
| D-Sorbitol | 80 | D-Sorbitol | 50 |
| Water-Soluble Polymer (s) | 14 | Water-Soluble Polymer (s) | 15 |
| Modified POVAL MP203 | 178 | | |
| Modified Poly(vinyl-alcohol) "PVA217" | 85 | | |
| **Low Sensitive, Cyan Color-Forming Layer** | | | |
| Lime-Treated Gelatin | 825 | Lime-Treated Gelatin | 825 |
| Emulsion A-3r (Silver Amount) | 300 | Emulsion A-3r (Silver Amount) | 300 |
| Silver Behenate | 1016 | Silver 5-Amino-3-Benzylthiotriazole | 157 |
| 1-Phenyl-2-Heptyl-5-Mercapto-1,3,4-Triazole | 20 | | |
| Cyan Coupler CP-320 | 99 | Cyan Coupler CP-320 | 99 |
| Cyan Coupler CP-324 | 234 | Cyan Coupler CP-324 | 234 |
| DEVP-23 | 139 | DEVP-26 | 411 |
| 6-Isopropylphthalazine | 118 | | |
| Organo-Polyhalogen Compound (1) | 81 | | |
| Organo-Polyhalogen Compound (2) | 26 | | |
| Organo-Polyhalogen Compound (3) | 27 | Antifoggant (d) | 4.8 |
| High Boiling Point Organic Solvent (g) | 471 | High Boiling Point Organic Solvent (j) | 372 |

TABLE 1-continued

Composition of Each Layer of Color Photothermographic Material (Part by Weight).

| Color Photothermographic Material 101 | | Color Photothermographic Material 102 | |
|---|---|---|---|
| Surfactant (y) | 29 | Surfactant (y) | 17 |
| D-Sorbitol | 80 | D-Sorbitol | 100 |
| Water-Soluble Polymer (s) | 14 | Water-Soluble Polymer (s) | 10 |
| Modified POVAL MP203 | 206 | | |
| Modified Poly(vinyl-alcohol) "PVA217" | 75 | | |
| Antihalation Layer | | | |
| Lime-Treated Gelatin | 700 | Lime-Treated Gelatin | 700 |
| Surfactant (y) | 14 | Surfactant (y) | 14 |
| Leuco Dye (67) | 150 | Leuco Dye (67) | 150 |
| Developer PH-1 | 144 | Developer PH-1 | 144 |
| Stearyl Alcohol | 260 | Stearyl Alcohol | 260 |
| Water-Soluble Polymer (s) | 15 | Water-Soluble Polymer (s) | 15 |

Transparent PET Substrate Having Back Layers (Total Thickness: 90 μm)

For comparison, uncolored, comparative photosensitive materials 103 and 104 were produced in the same manner as the photosensitive materials 101 and 102 of the present invention except that the leuco dyes were removed from the yellow filter layer, the magenta filter layer and the antihalation layer, respectively.

A sample strip was cut off from each of the photosensitive materials 101 to 104 and exposed to light of 10 lux through a resolving power chart for 1/100 second. After exposure, each sample was heat-developed by means of a heat drum. Development was conducted at 120° C. for 15 seconds for the photosensitive materials 101 and 103, while at 150° C. for 20 seconds for the photosensitive materials 102 and 104.

As a result, the samples of the photosensitive materials 101 and 102 of the present invention were colored black all over the face after image formation, however, they were considerably decolored at 70° C. so that the pattern of 16 lines/mm could be clearly resolved. On the other hand, the resolving power of each of the comparative photosensitive materials 103 and 104 was 10 lines/mm or less.

Example 3

The photosensitive material 101 of the present invention produced in Example 2 was cut into APS format, perforated and filled in a cartridge, the cartridge was installed into an APS camera, and a person and Macbeth chart were photographed thereby.

The thus-exposed photosensitive material 101 was heated at 120° C. for 15 seconds by a heat drum. The image formed on the photosensitive material 101 was read by a CCD line scanner with respect to the cases where the temperature of the photosensitive material 101 was 70° C. and 25° C., respectively. The read data was image-processed on a work station, and the resulting image was output by a heat-developing printer "PICTROGRAPHY 4000" manufactured by Fuji Photo Film Co., Ltd. As a result, the image read at 70° C. was apparently excellent in graininess as compared with the image read at 25° C.

Further, the same evaluation of image was repeated after the photosensitive material 101 filled in the APS cartridge was allowed to stand at 70° C. for 2 hours and cooled to a room temperature. Consequently, the same results as above were obtained.

As mentioned in detail above, a photosensitive material of the present invention comprises a reversibly decolorable colored layer, which is in a colored state at room temperature and reversibly decolored at a temperature equal to or higher than a decoloration initiation temperature, whereby the photosensitive material exhibit an excellent stability even under hard storage conditions and can be easily decolored if necessary. The reversibly decolorable colored layer can be decolored with ease even in a dry-processing where decoloring cannot be conducted by a liquid treatment, thus, the photosensitive material of the present invention is especially advantageous as a heat-developable photosensitive material (photothermographic material).

What is claimed is:

1. A photosensitive image-forming material which comprises a photosensitive image-forming layer, said photosensitive image-forming material comprising a substrate and a reversibly decolorable colored layer disposed thereon, wherein said reversibly decolorable colored layer is reversibly colored and decolored, said reversibly decolorable colored layer is in a colored state at 25° C., and a temperature at which the color density of said reversibly decolorable colored layer is reduced to 50% based on that at 25° C. is 50 to 120° C., wherein said reversibly decolorable colored layer can be the photosensitive image-forming layer.

2. The photosensitive image-forming material according to claim 1, wherein said reversibly decolorable colored layer comprises: an electron-donating, organic color-former; a compound having a phenolic hydroxyl group; and at least one compound selected from the group consisting of alcohols, esters, ketones and ethers.

3. The photosensitive image-forming material according to claim 1, wherein said photosensitive image-forming material is a silver halide photosensitive image-forming material for photographing comprising a photosensitive image-forming layer comprising a silver halide, a dye-providing compound and a binder.

4. The photosensitive image-forming material according to claim 3, wherein said photosensitive image-forming material is a heat-developable photosensitive material comprising said photosensitive image-forming layer comprising an organic silver salt.

5. A method for forming an image comprising the steps of: exposing the photosensitive image-forming material recited in claim 4; developing the exposed photosensitive image-forming material to provide an image information thereon; and reading said image information by a scanner at said temperature of 50 to 120° C. or higher to produce an image data.

6. A method for forming an image comprising the steps of: exposing the photosensitive image-forming material recited in claim 3; developing the exposed photosensitive image-forming material to provide an image information thereon; and reading said image information by a scanner at said temperature of 50 to 120° C. or higher to produce an image data.

* * * * *